US006234359B1

(12) United States Patent
Brown et al.

(10) Patent No.: US 6,234,359 B1
(45) Date of Patent: May 22, 2001

(54) SYSTEM FOR RELOADING DISPENSING TOOLS

(75) Inventors: Jeffery E. Brown, North Canton; Aaron D. Marshall, East Canton; William C. Schiltz, Canton, all of OH (US)

(73) Assignee: Liquid Control Corporation, North Canton, OH (US)

( * ) Notice: Subject to any disclaimer, the term of this patent is extended or adjusted under 35 U.S.C. 154(b) by 0 days.

(21) Appl. No.: 09/272,681

(22) Filed: Mar. 19, 1999

Related U.S. Application Data

(60) Provisional application No. 60/078,816, filed on Mar. 20, 1998.

(51) Int. Cl.[7] ..... B67D 5/52
(52) U.S. Cl. ..... 222/255; 222/252
(58) Field of Search ..... 222/137, 145.6, 222/389, 1, 61, 64, 255, 252, 256, 262, 263

(56) References Cited

U.S. PATENT DOCUMENTS

| | | | | |
|---|---|---|---|---|
| 3,758,005 | | 9/1973 | Christine et al. | 222/309 |
| 4,164,197 | * | 8/1979 | Nelson | 222/137 |
| 4,453,651 | * | 6/1984 | Braithwaite et al. | 222/389 X |
| 4,635,830 | * | 1/1987 | Wehr et al. | 222/389 |
| 4,676,410 | * | 6/1987 | Von Flue | 222/137 |
| 4,682,711 | * | 7/1987 | Reighard et al. | 222/255 |
| 4,801,097 | * | 1/1989 | Fitch, Jr. | 222/255 |
| 4,932,094 | | 6/1990 | McCowin | 15/29 |
| 5,020,693 | * | 6/1991 | Ernst et al. | 222/389 X |
| 5,184,758 | * | 2/1993 | Keller | 222/389 X |
| 5,407,287 | | 4/1995 | Braun et al. | 401/176 |
| 5,823,388 | * | 10/1998 | Green | 222/61 |

FOREIGN PATENT DOCUMENTS

| | | |
|---|---|---|
| 0 052 060 A1 | 10/1981 | (EP) . |
| 0 924 071 A1 | 6/1999 | (EP) . |
| 2 162 902 | 2/1986 | (GB) . |
| WO 86/04047 | 7/1986 | (WO) . |

* cited by examiner

*Primary Examiner*—Philippe Derakshan
*Assistant Examiner*—Thach H Bui
(74) *Attorney, Agent, or Firm*—Sand & Sebolt

(57) ABSTRACT

A dispensing tool according to the present invention includes a dispensing outlet and at least a first material storage tube having a material storage chamber and an outlet. The tool also includes a drive assembly that is at least partially disposed within the first material storage tube and adapted to dispense material from the first material storage tube through the dispensing outlet. A valve assembly selectively controls the flow of material from the material storage tube to the dispensing outlet. The valve assembly and the drive assembly are linked such that activation of the drive assembly causes the valve to open allowing material to be dispensed. When the drive assembly is stopped, the valve is automatically closed. Material may be reloaded into the material storage tube through an inlet that is selectively connected to a source of bulk material. The selective connection may be provided by a controllable valve, or a selective connection between a pair of coupling elements. Indicators are provided to tell the user when the tool is full and to turn off the pumps for the bulk material when the connection between the couplings is broken.

39 Claims, 20 Drawing Sheets

| FIG-2A | FIG-2B | FIG-2C |
|---|---|---|

SYSTEM FOR RELOADING DISPENSING TOOLS

CROSS REFERENCE TO RELATED APPLICATIONS

This Application claims priority from U.S. Provisional Application Ser. No. 60/078,816 filed Mar. 20, 1998, the disclosures of which are incorporated herein by reference.

BACKGROUND OF THE INVENTION

1. Technical Field

This invention generally relates to dispensing tools and, more particularly, a system for automatically reloading a dispensing tool. Specifically, the present invention relates to a system for reloading a two-component dispensing tool automatically when the tool is either idle or placed in a reloading holster.

2. Background Information

Dispensing tools are used in a variety of applications to dispense materials such as adhesives, caulks, sealants, and other like materials. These dispensing tools may be used as hand held tools or, in other applications, may be part of an automated line where the material being dispensed is automatically dispensed onto the target by an automatic controller.

A common material that is dispensed with such dispensing tools is a two-component adhesive. A two-component adhesive typically includes a resin and a curative that must be stored separately until mixed to form the adhesive. The resin and curative are typically sold in disposable cartridges ranging in size from 50 ml to 80 ml. When the cartridges are empty, they are either disposed of or sent to a third party who refills the cartridges. Both of these options are relatively expensive because the cartridge must be repeatedly purchased when the cartridges are disposed of and postage must be paid when the cartridges are mailed back and forth to be refilled. The cost of resin is in the approximate range of 0.06 to 0.11 cents per milliliter when the resin is purchased in disposable cartridges. The same resin purchased in bulk costs only between the approximate range of 0.008 and 0.014 cents per milliliter. The significant difference in cost is attributed mostly to the packaging. It is thus desired in the art to provide a dispensing gun that cooperates with a system that allows the dispensing gun to be reloaded with resin and curative from bulk storage containers.

SUMMARY OF THE INVENTION

It is thus an objective of the present invention to provide a system for reloading dispensing tools that stores the material to be reloaded in bulk containers.

Another objective of the present invention is to provide a system for reloading dispensing tools that automatically reloads the dispensing tool when the tool is at rest or placed in a reloading holster.

Still another objective of the present invention is to provide a system for reloading dispensing tools that utilizes the selective delivery of pressurized air to dispense the material and to allow reloading to occur.

Yet another objective of the present invention is to provide a system for reloading dispensing tools that provides a signal to the operator when the tool is fully reloaded.

A further objective of the present invention is to provide a system for reloading dispensing tools that allows all of the material storage tubes in a multi-component dispensing tool to be reloaded simultaneously.

Still a further objective of the present invention is to provide a system for reloading dispensing tools that may be used with different bulk material storage containers.

Yet a further objective of the present invention is to provide a system for reloading dispensing tools that reloads the dispensing tool automatically without requiring the user to perform any steps to activate the reloading process.

Another objective of the present invention is to provide a system for reloading dispensing tools that may be used with a wide variety of existing dispensing tools.

Another objective of the present invention is to provide a docking station or holster for a dispensing tool that includes a clamping mechanism that creates a position engagement between the dispensing tool and the docking station while the dispensing tool is being refilled.

Another objective of the present invention is to provide a system for reloading dispensing tools having a docking station or holster that includes a switch that controls the actuation of the pumps such that the pumps are only actuated when the dispensing tool is configured to receive material.

Another objective of the present invention is to provide a system for reloading dispensing tools that is of simple construction, which achieves the stated objectives in a simple, effective, and inexpensive manner, in which solves the problems and which satisfies the needs existing in the art.

These and other objectives and advantages of the present invention are achieved by a dispensing tool including a dispensing outlet; at least a first material storage tube having a material storage chamber and an outlet; a drive assembly at least partially disposed within the first material storage tube; and a valve assembly selectively moveable between open and closed positions; the open position providing fluid communication between the outlet of the first material storage tube and the dispensing outlet of the tool.

Other objectives and advantages of the invention are achieved by a method for dispensing material from and reloading material into a dispensing tool having at least a first material storage tube having a first material storage chamber with an inlet and an outlet; the method including the steps of sealing the inlet to the material storage chamber; providing a valve at the outlet to the material storage chamber; opening the valve; and dispensing material from the material storage chamber with a drive assembly.

BRIEF DESCRIPTION OF THE DRAWINGS

The preferred embodiments of the invention, illustrative of the best modes in which applicant contemplated applying the principles of the invention, are set forth in the following description and are shown in the drawings and are particularly and distinctly pointed out and set forth in the appended claims.

Similar numbers refer to similar elements throughout the specification.

DESCRIPTION OF THE PREFERRED EMBODIMENTS

Figure 1:
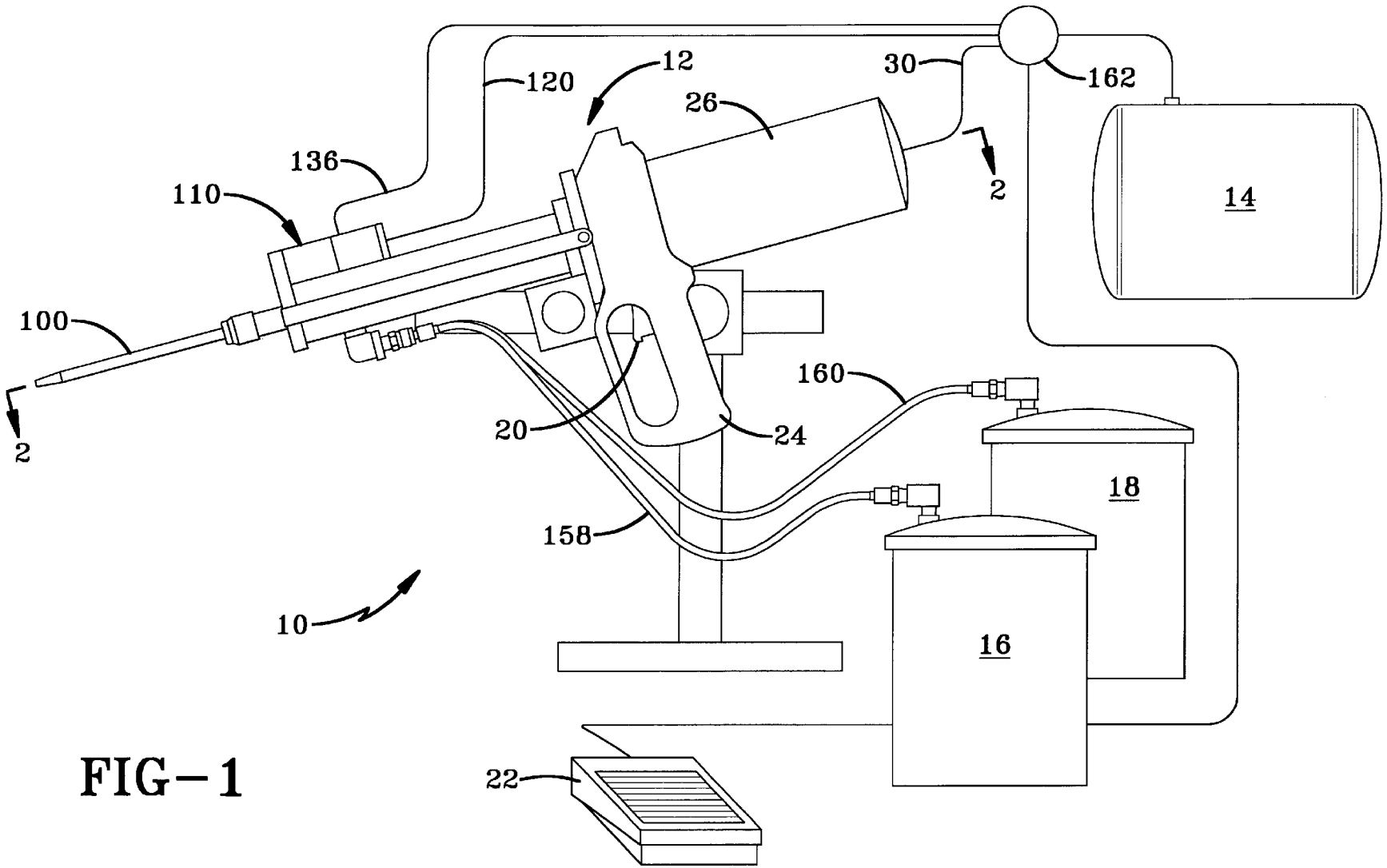
FIG. 1 is an overall schematic view of a system for reloading a dispensing gun according to the present invention.

An overall schematic view of a system for reloading dispensing tools according to the concepts of the present invention is depicted in FIG. 1 with the system indicated generally by the numeral 10. System 10 generally includes a dispensing tool, indicated generally by the numeral 12, a source of pressurized air 14 in selective fluid communication with dispensing tool 12, and at least one source 16 or 18 of material to be loaded into dispensing tool 12. System 10 operates by automatically reloading tool 12 with the material stored in sources 16 and 18. The selective dispensing and reloading of tool 12 may be controlled by a trigger carried by dispensing tool 12 or by a remote trigger 22 such as the foot pedal depicted in FIG. 1. Dispensing occurs through the selective delivery of pressurized air to tool 12.

Dispensing tool 12 depicted in the drawings as an example for use with system 10 is a two-component dispensing tool meaning that tool 12 is capable of separately storing two materials and mixing the two materials only when they are dispensed from tool 12. It should be noted that other dispensing tools known in the art such as single component dispensing tools and other multi-component dispensing tools may also be used with system 10 of the present invention without departing from the concepts of the present invention. In order to provide an example of the best mode now contemplated for employing system 10, dispensing tool 12 is described as a two-component dispensing tool. As such, dispensing tool 12 generally includes a handle 24 that carries trigger 20. A cylinder 26 is connected to handle 24 and extends rearwardly therefrom. Cylinder 26 is substantially hollow with a substantially cylindrical, smooth inner surface 27. Cylinder 26 is sealed at its outer end by an end wall 28. An air supply line 30 is attached to cylinder 26 through end wall 28 by a suitable connector 32. While cylinder 26 may be substantially cylindrical in the preferred embodiment, it may take other forms or it may have other cross-sections without departing from the spirit of the present invention.

Dispensing tool 12 further includes a drive piston 40 that includes a pair of drive shafts 42 and 44 slidably disposed through handle 24, a common pneumatic drive piston head 46 disposed in cylinder 26 between end wall 28 and shafts 42 and 44, and a pair of material drive piston heads 48 and 50 connected to the other ends of shafts 42 and 44. Shafts 42 and 44 may not be connected to piston head 46 so that shafts 42 and 44 may move independent from one another during reloading. In other embodiments, each shaft 42 and 44 is connected to piston head 46 so that shafts 42 and 44 will move at the same speed. Pneumatic drive piston head 46 is configured to form a fluid-tight seal between inner surface 27 of cylinder 26 and itself so as to form a first chamber 52 between end wall 28 and piston head 46. First chamber 52 is thus in selective fluid communication with source of pressurized air 14 through at least air supply line 30.

As described above, each drive shaft 42 and 44 is slidably disposed through handle 24. Such a sliding connection is provided by a pair of passageways 54 and 56 having internal diameters slightly greater than the external diameters of shafts 42 and 44. A block 58 may be provided adjacent the forward surface of handle 24 that is either connected to handle 24 by suitable connectors or integrally formed with handle 24. Block 58 carries a bearing 60 between each shaft 42 and 44 and block 58 that allows shafts 42 and 44 to easily slide through block 58.

A material storage tube 62 is disposed adjacent the forward surface of block 58 for each material drive piston head 48 and 50. Each material storage tube 62 has an inner wall 64 that forms a fluid-tight connection between itself and material drive piston heads 48 and 50. Although material storage tubes 62 depicted in the drawings have chambers 66 for holding material 68 to be dispensed of approximately the same volume, storage tubes 62 may be utilized with system 10 having different volumes for use with multi-component materials 68 that have different mixing ratios. For example, one chamber 66 may have a volume that is 10 times the volume of the other chamber 66. In such an embodiment, the other elements of dispensing tool 12 are sized to accommodate the mixing ratio of materials 68. Each tube 62 includes a substantially cylindrical sidewall 70 bounded at one end by an end wall 72. Sidewall 70 and end wall 72 are at least partially held in place by a retaining sleeve 74. A cover 76 may also be provided that substantially surrounds tubes 62 and clamps tubes 62 and other elements described below between block 58 and a second end wall 78. Cover 76 may be attached to block 58 by any of a variety of appropriate means with bolts 80 being depicted as one example of an appropriate connector.

Figures 2, 2A:
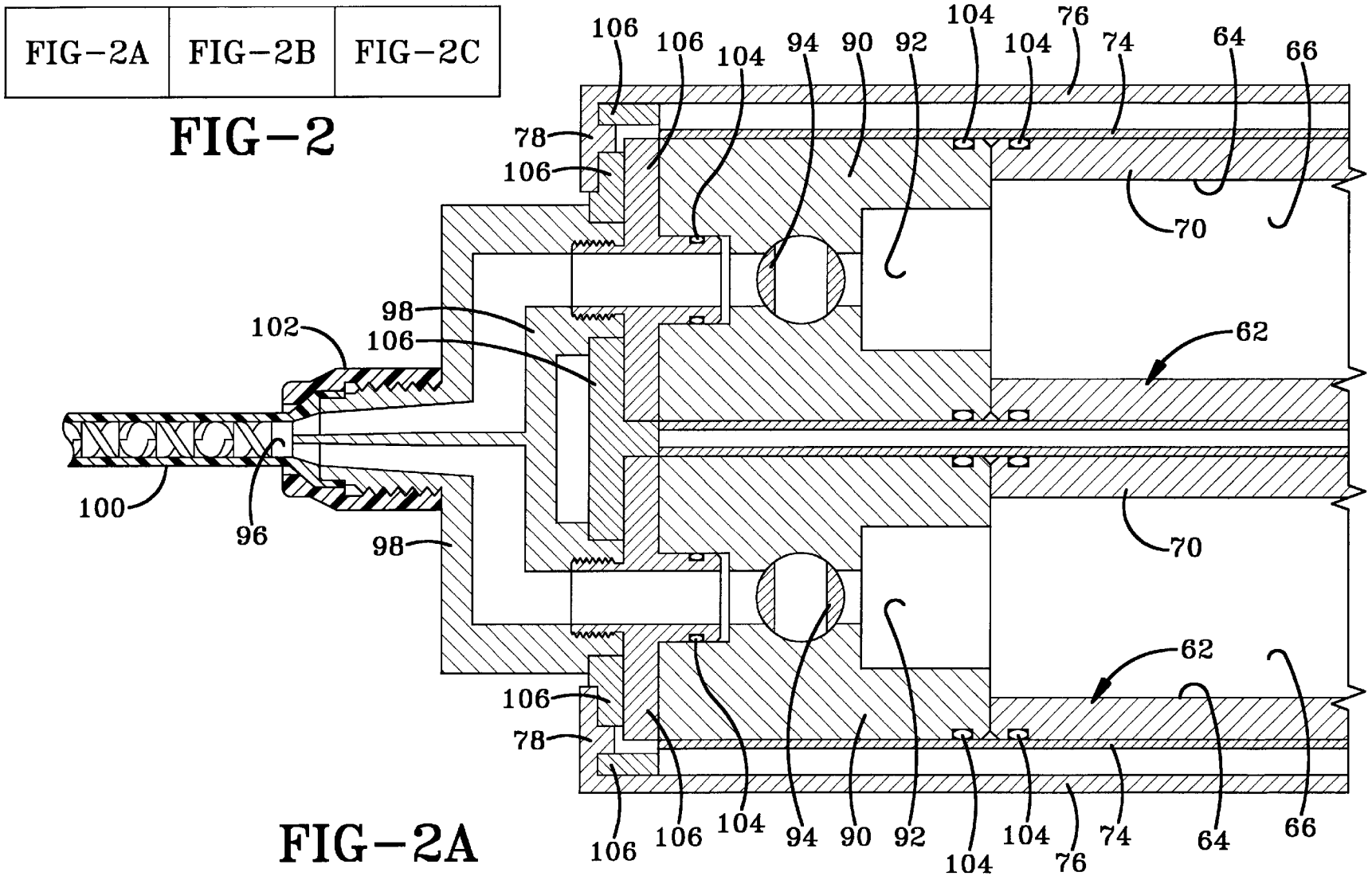
FIG. 2 is a legend showing the relationship between FIGS. 2A, 2B, and 2C.
FIG. 2A is the first portion of the sectional view taken along line 2—2 of FIG. 1 depicting the front third of a dispensing gun used with the system of the present invention.
Figure 2B:
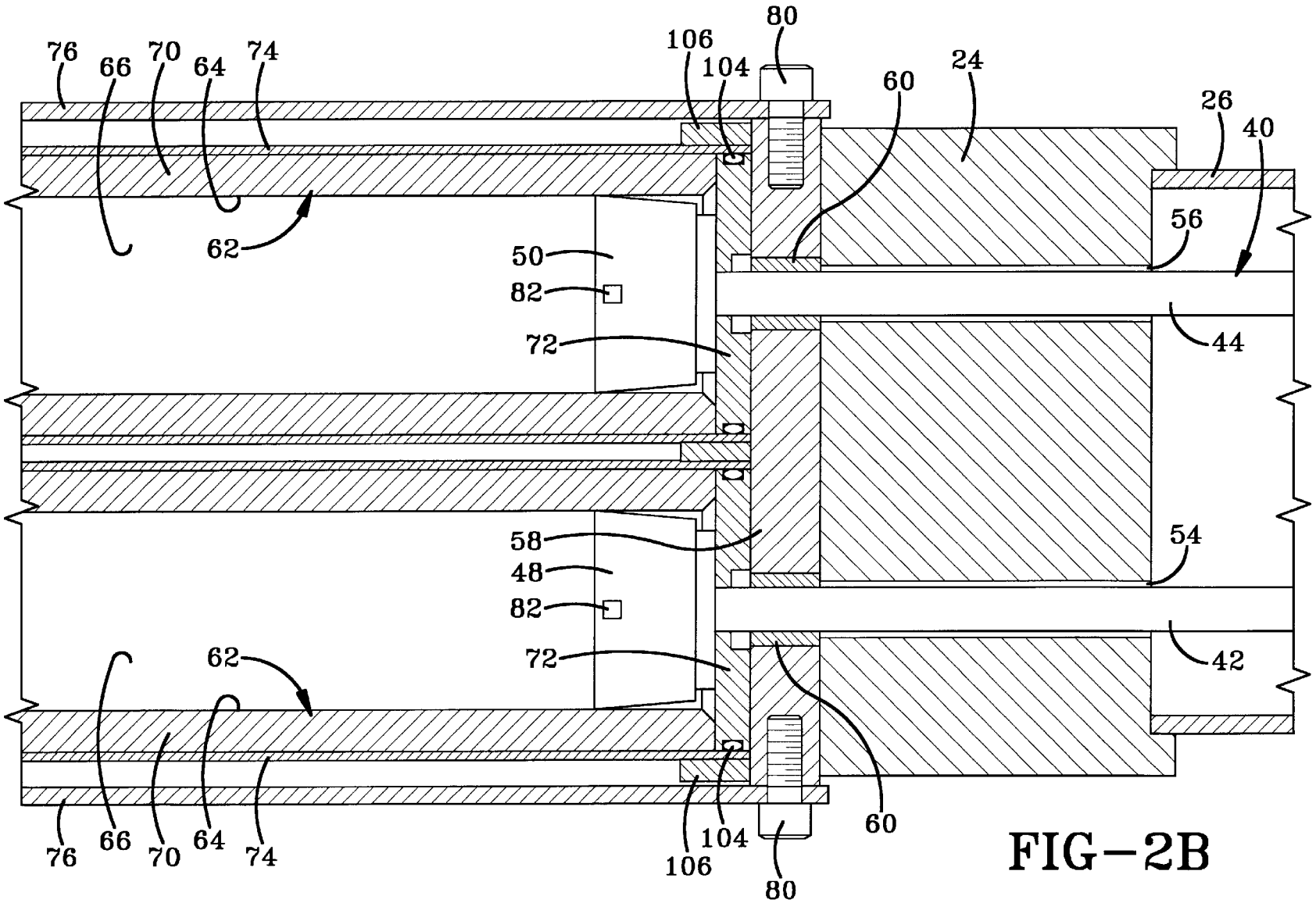
FIG. 2B is the middle portion of the sectional view taken along line 2—2 of FIG. 1 depicting the middle of a dispensing gun used with the system of the present invention.
Figure 2C:
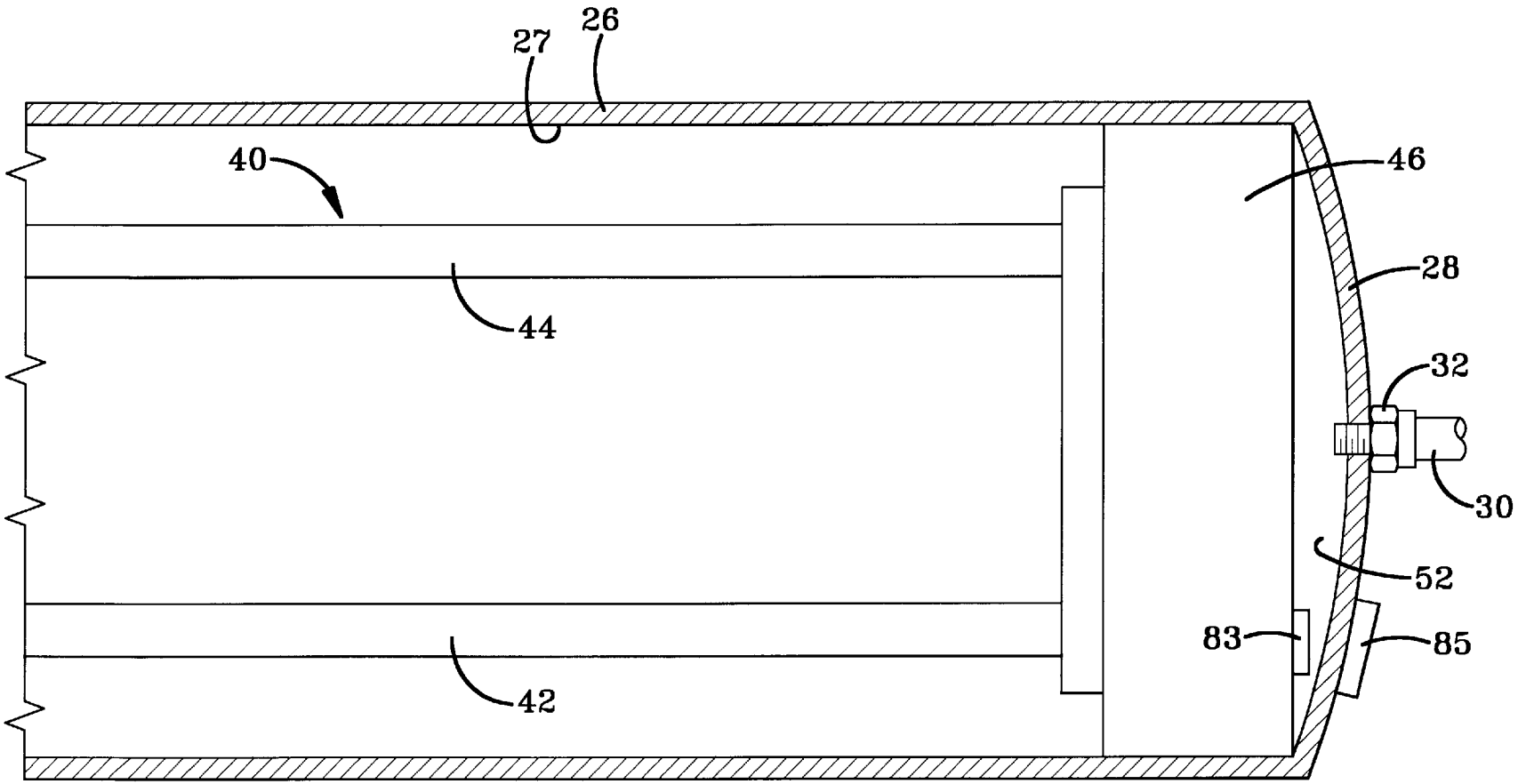
FIG. 2C is the end portion of the sectional view taken along line 2—2 of FIG. 1 depicting the end of a dispensing gun used with the system of the present invention.
Figure 5:
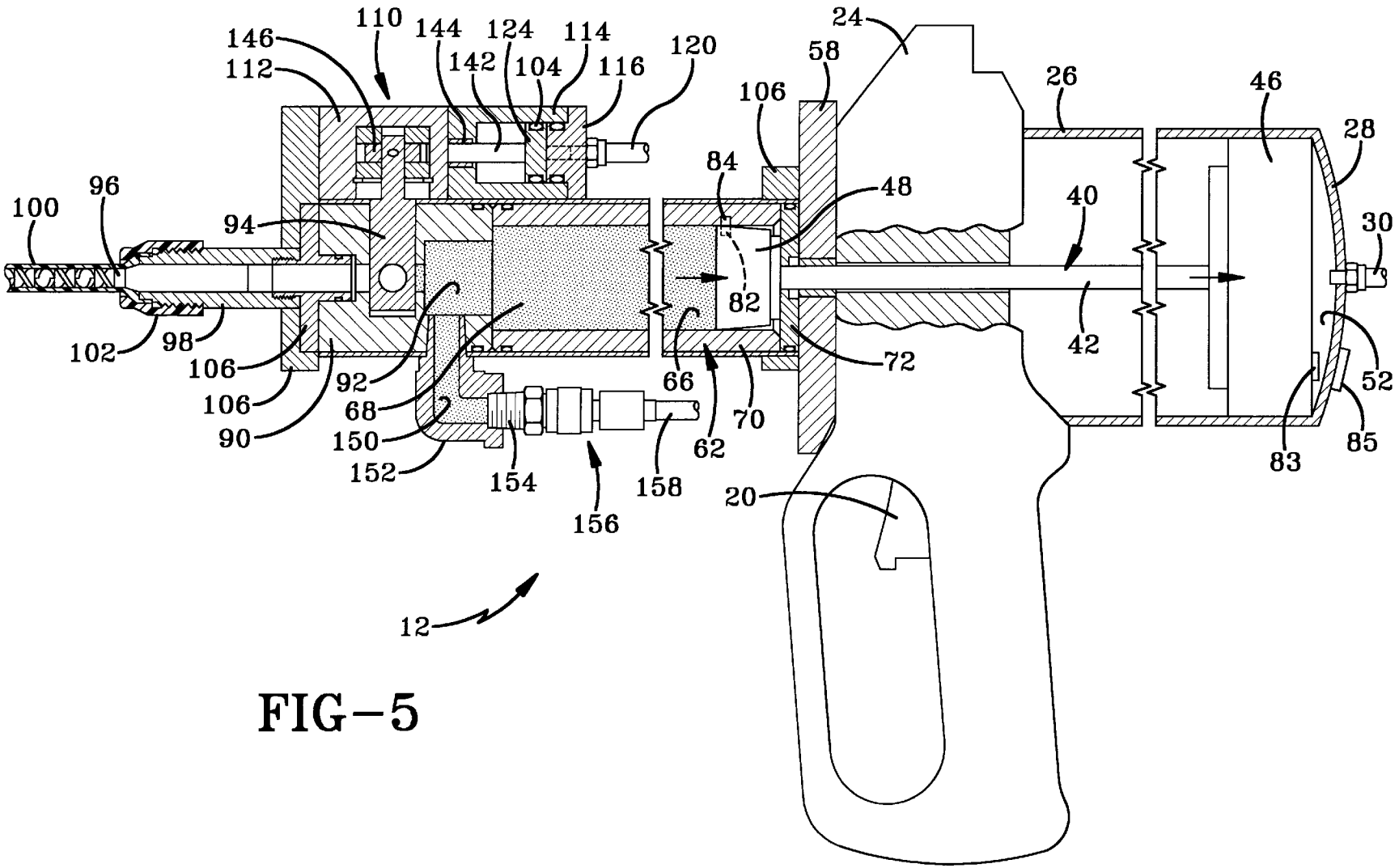
FIG. 5 is a sectional side view of the dispensing gun of FIG. 3 after it has been fully loaded.

A sensor element 82 is carried by each material drive piston head 48 and 50 in a position where it may cooperate with a corresponding sensor element 84 configured in sidewall 70 of storage tubes 62. Sensor elements 82 and 84 are disposed to activate a signal when a material drive piston head 48 or 50 is in the loaded position depicted in FIGS. 2B and 5. Sensor elements 82 and 84 may be any of a variety of known sensors. For example, sensor elements 82 and 84 may be in the form of a magnetic sensor. Sensor 84 may also be located outside of storage tubes 62 in other embodiments of the present invention. Another sensor configuration that achieves the objective of the present invention of providing an indication of when dispensing tool 12 is filled is indicated by the numerals 83 and 85 in the drawings. Sensor 83 is carried by drive piston head 46 with sensor element 85 being carried by cylinder 26 and preferably on the outer surface of cylinder 26. Sensors 83 and 85 are configured to create a signal when they are closely adjacent as depicted in FIG. 2C. In one embodiment of the present invention, sensor 83 is a magnet and sensor element 85 is a sensor of the type capable of sensing the magnetic field produced by magnet 83 and creating a signal based on the presence of the magnetic field.

A pair of valve blocks 90 are positioned in front of each material storage tube 62. Each valve block 90 has a passageway 92 therethrough which is selectively opened and closed by a rotatable valve 94. When rotatable valve 94 is in the closed position as depicted in FIGS. 2A, 3, 5, 8, and 9 passageway 92 is sealed and material 68 cannot be dispensed from chambers 66. Passageways 92 join at a mixing chamber 96 such that material 68 from each tube 62 is mixed in mixing chamber 96 when valves 94 are opened and material 68 is dispensed by dispensing tool 12. Passageways 92 are formed between front body members 98 that may be attached to end wall 78 of cover 76 by appropriate means or otherwise supported on dispensing tool 12. Mixing chamber 96 is disposed in a dispensing nozzle 100 such that the mixed materials 68 are forced out of nozzle 100 when dispensed by dispensing tool 12. An appropriate collar 102 may be used to hold nozzle 100 on front body members 98.

Appropriate seals 104 and body elements such as indicated by the numeral 106 are provided throughout dispensing tool 12 as needed. It may now be appreciated that dispensing tool 12 is configured such that common pneumatic drive piston head 46 may be driven towards handle 24 by pressurized air supplied to first chamber 52 by source of pressurized air 14. When piston head 46 is driven toward handle 24, shafts 42 and 44 function to drive piston heads 48 and 50 away from handle in storage tubes 62. Such movement forces any material in storage tubes 62 into passageways 92 and out into mixing chamber 96 when valves 94 are open. Similarly, a supply of fluid pressure to chambers 66 of storage tubes 62 causes piston heads 48 and 50 to move back towards handle 24 when valves 94 are closed. Such movement is transmitted by shafts 42 and 44 back to common pneumatic drive piston head 46 causing it to return to its initial position depicted in FIG. 2C.

Figure 4:
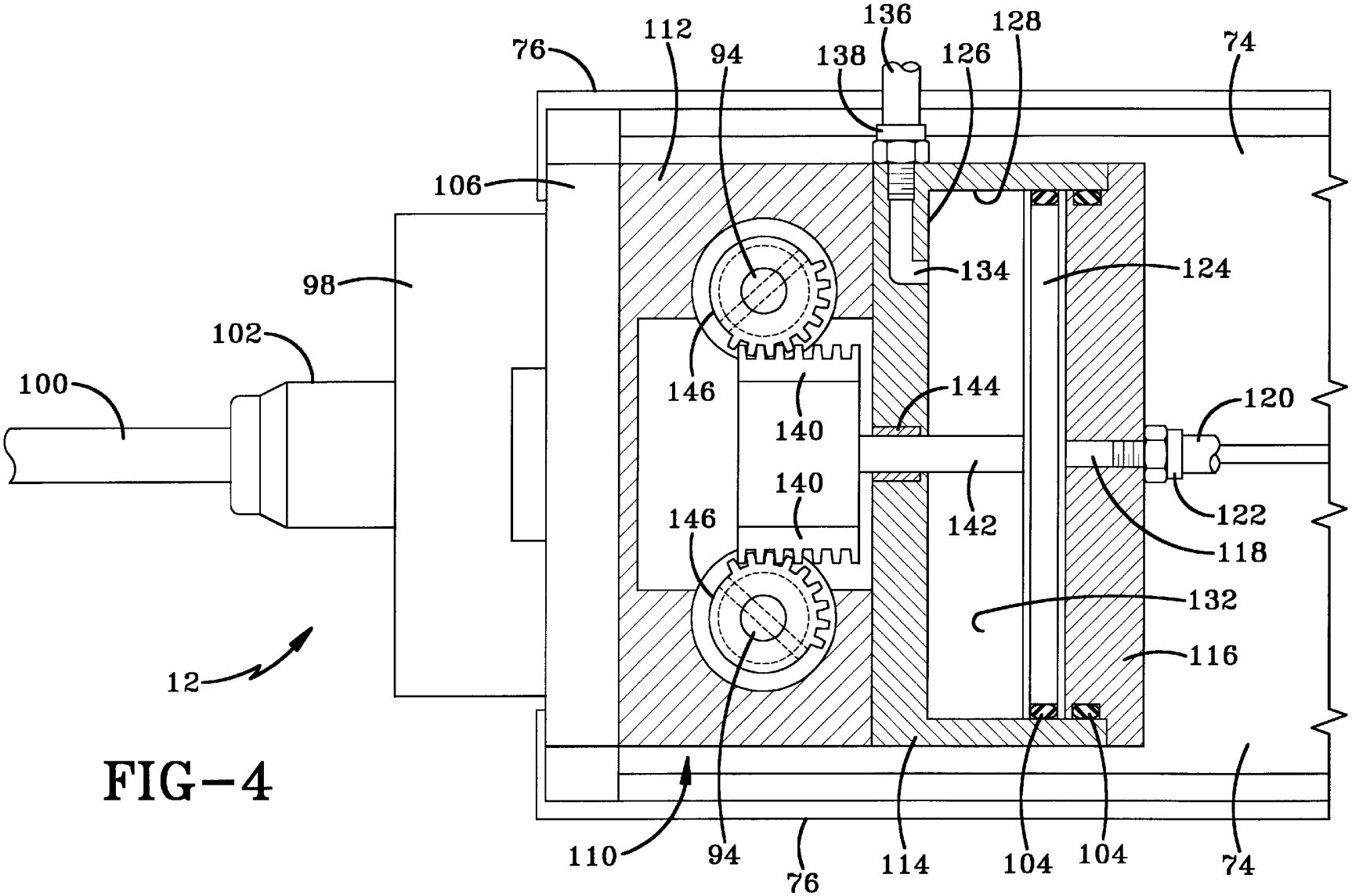
FIG. 4 is a sectional view taken along line 4—4 of FIG. 3 depicting the dispensing valves in a closed position.
Figure 6:
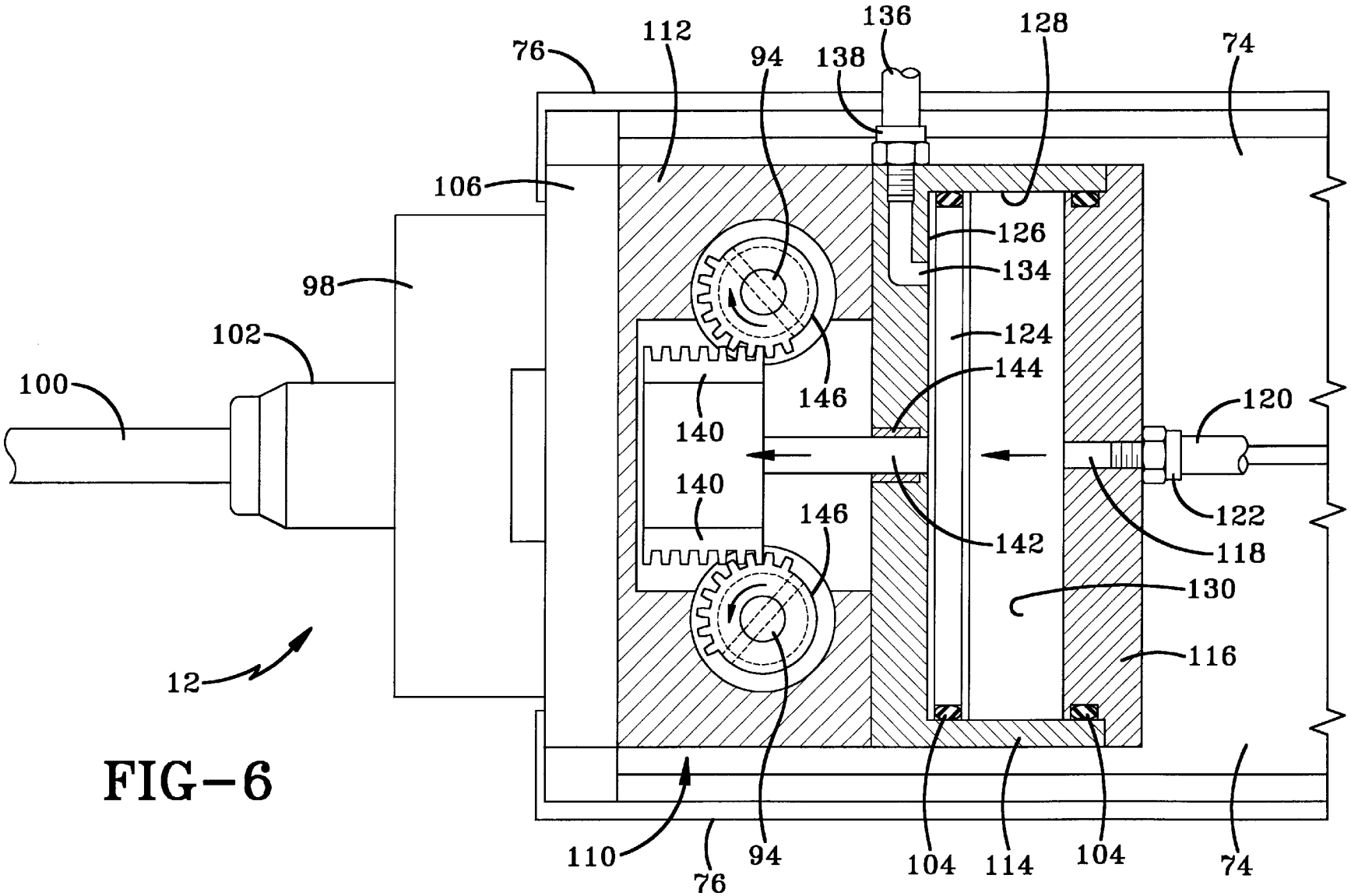
FIG. 6 is a sectional view similar to FIG. 4 with the dispensing valves in the open position.

In accordance with one objective of the present invention, valves 94 are controlled by a pneumatic switch 110 that may be seen in FIGS. 4 and 6. Pneumatic switch 110 generally includes a valve body 112 that rotatably supports each valve 94. A cap block 114 is disposed adjacent valve body 112 and may be formed integrally therewith or connected by suitable means such as bolts, screws, welds, or the like. A cap 116 is sealingly attached to cap block 114. An air supply passageway 118 extends through cap 116 and is in fluid communication with an air supply line 120 that may be attached to cap 116 by a suitable connector 122.

A valve piston head 124 is disposed in cap block 114 between cap 116 and end wall 126 of cap block 114. Valve piston head 124 engages inner sidewall 128 of cap block 114 in a fluid-tight engagement to form a dispensing chamber 130 between valve piston head 124 and cap 116 and a reload chamber 132 between valve piston head 124 and end wall 126 of cap block 114. An air supply passageway 134 is formed in cap block 114 to provide fluid communication between reload chamber 132 and an air supply line 136. Air supply line 136 is connected to cap block 114 by an appropriate connector 138.

Valve piston head 126 is connected to a pair of racks 140 by a shaft 142 that slides through cap block 114 and is held in place by an appropriate bearing 144 that also functions as a seal. Racks 140 are disposed to meshingly engage pinion gears 146 that are connected to valves 94. As such, translation of piston head 124 causes simultaneous translation of racks 140 which, in turn, engage pinion gears 146 causing gears 146 and valves 94 to rotate. Pneumatic switch 110 is configured such that valves 94 are closed when piston head 124 abuts cap 116 and are open when piston head 124 abuts end wall 126. This dual rack 140 and dual pinion gear 146 arrangement ensures that material 68 from each chamber 66 is dispensed to mixing chamber 96 simultaneously. Switch 110 also allows the dispensing to be precisely controlled by selectively delivering pressurized air to different locations of tool 12.

A supply passageway 150 is in fluid communication with each passageway 92 in valve blocks 90 between valves 94 and chambers 64. Supply passageway 150 is formed in a supply coupling 152 that carries a connector 154 that attaches coupling 152 to a valve 156. Each valve 156 is, in turn, connected to reload supply line 158 and 160 such that each tube 62 of tool 12 is connected to a material supply. Reload supply line 158 provides fluid communication between valve 156 and source 16 of first material. Similarly, reload supply line 160 provides fluid communication between its valve 156 and source 18 of second material. Valves 156 may each include a spring that forces valve 156 closed when sources 16 and 18 are not pressurized. Material from sources 16 and 18 may be delivered to valves 156 by any of a variety of appropriate means known in the art such as suitable pumps. Sources 16 and 18 may be configured to accommodate material packaged in 1 gallon, 5 gallon, 55 gallon, or other shipping containers.

Air supply lines 30, 120, and 136 are connected to source of pressurized air 14 by a controllable valve 162. Valve 162 is selectively controlled by trigger 20 or foot pedal 22 or by an automated programmable controller. Valve 162 is capable of selectively directing pressurized air to chamber 52, chamber 130, or chamber 132. Valve 162 is also capable of exhausting air from these chambers. Valve 162 may be a single valve or a combination of cooperating valves. The control mechanisms for operating valve 162 are known to those skilled in the art and may be any of the variety that are known in the art. Valve 162 is preferably disposed in the handle of tool.

The operation of system 10 for reloading dispensing tool 12 is now described with reference to FIGS. 3 through 7. Prior to reloading, storage tubes 62 of dispensing tool 12 may be empty or substantially empty. In this position, drive piston 40 is disposed in the unloaded position where piston heads 48 and 50 are adjacent valve blocks 90. The pressurized air is then exhausted by valve 162 from chamber 52. Material 68 from sources 16 and 18 is then delivered to valve 156 under sufficient pressure to cause valve 156 to open and provide fluid communication between supply passageway 150 and sources 16 and 18. Sources 16 and 18 may be automatically pressurized when pressurized air is exhausted from chamber 52. In such an embodiment, tubes 62 are automatically reloaded every time chamber 52 is evacuated.

Figure 3:
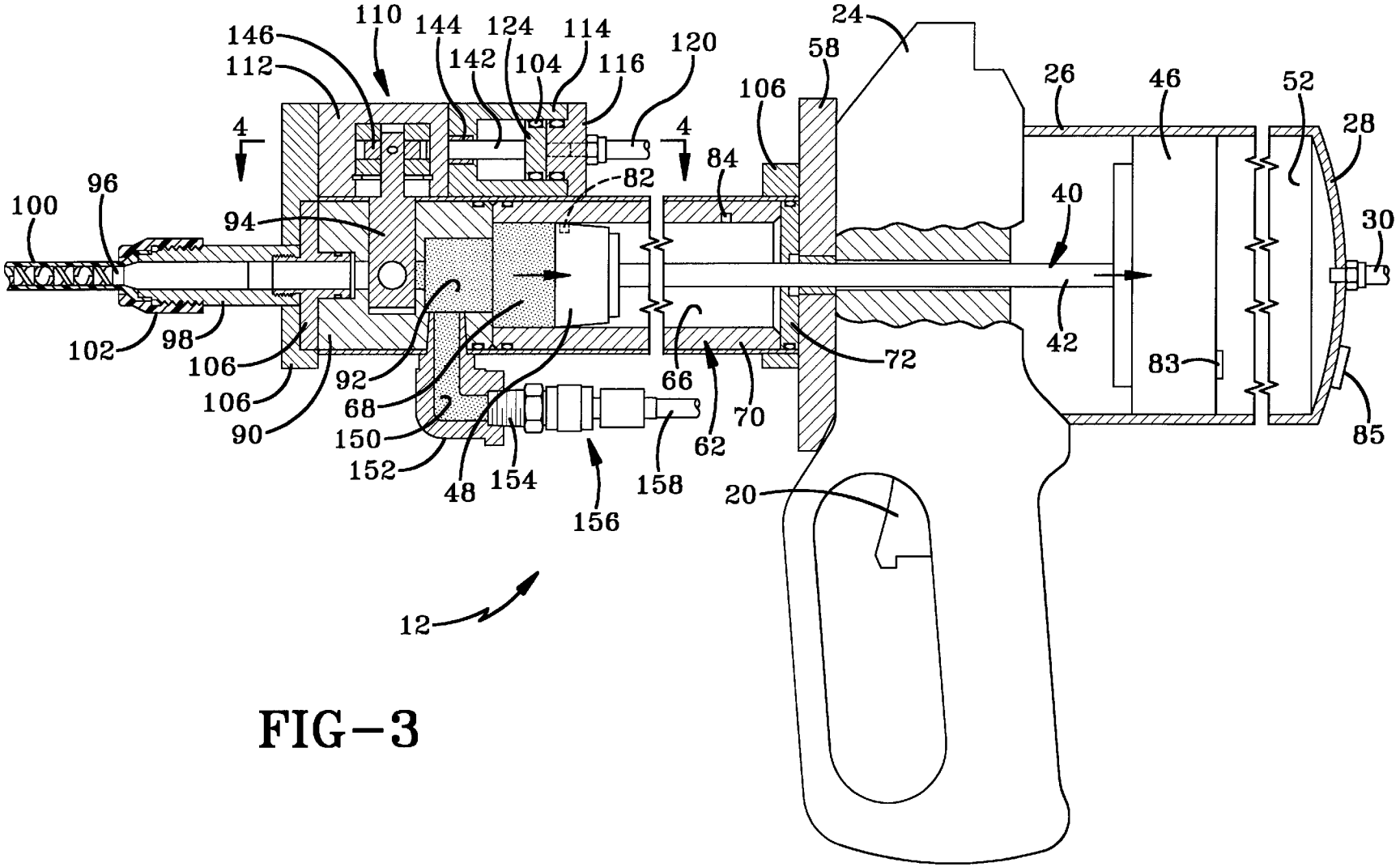
FIG. 3 is a sectional side view of a dispensing gun used with the system of the present invention depicting the gun while it is being reloaded.

In one embodiment of the present invention, valve 162 supplies pressurized air through supply line 136 to reload chamber 132 of pneumatic switch 110 to ensure that valves 94 are moved to their closed positions as depicted in FIG. 4. With valves 94 closed, in accordance with one objective of the present invention, material 68 supplied to passageway 92 moves back into chambers 66 and forces piston heads 48 and 50 back towards handle 24 as depicted in FIG. 3. Material 68 is pumped into chambers 66 until drive piston 40 is moved back to the fully loaded position depicted in FIGS. 2A through 2C and FIG. 5. When piston heads 48 and 50 reach the fully loaded position, sensor elements 82 and 84 interact and provide a signal to the operator that dispensing tool 12 is fully loaded. At this time, both chambers 66 are fully loaded with material 68 to be dispensed. The pressurized supply of material from sources 16 and 18 is then stopped and valve 156 closes.

Figure 7:
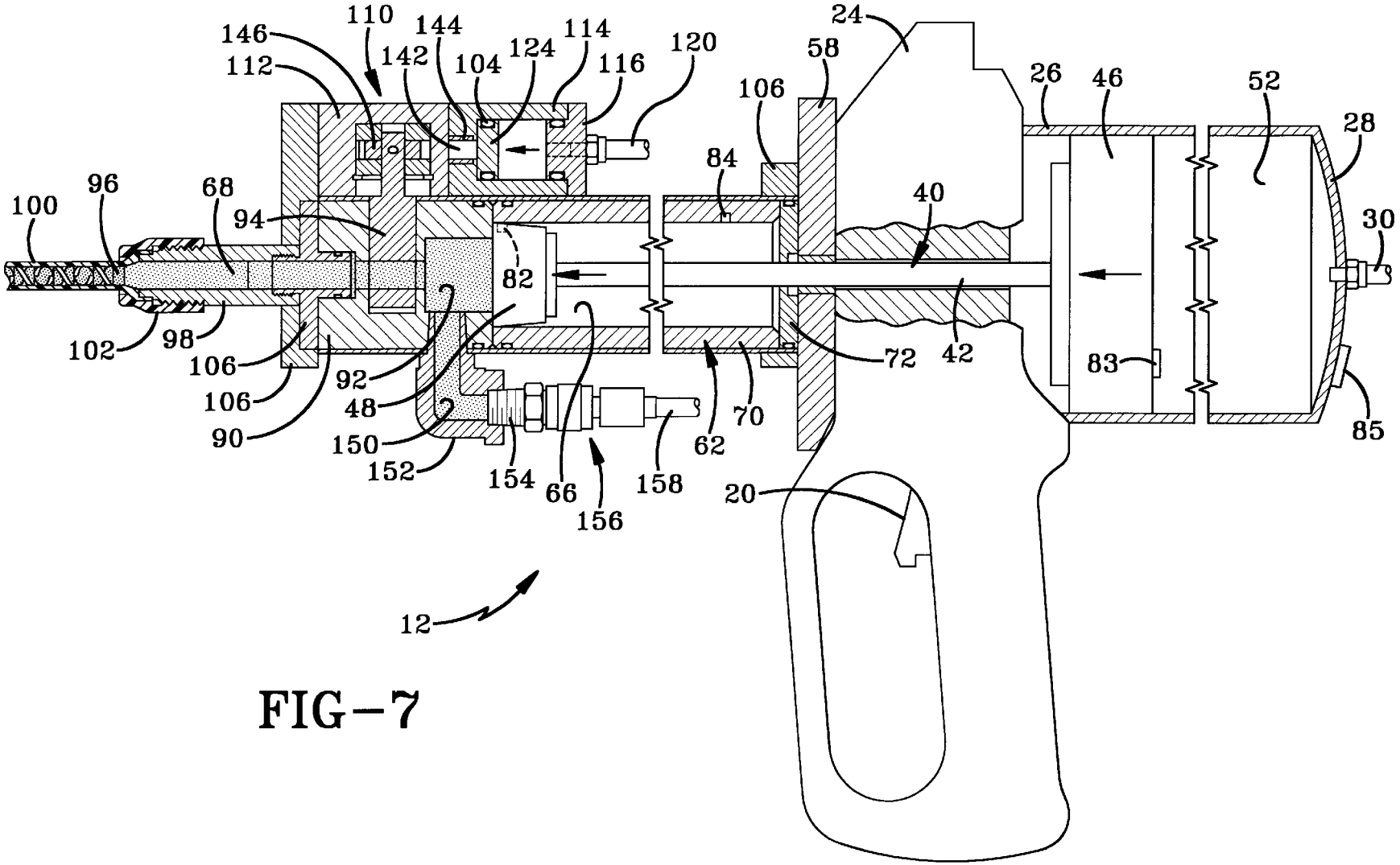
FIG. 7 is a sectional side view similar to FIG. 5 showing a substantially empty dispensing gun.

When the user desires to dispense material 68 from dispensing tool 12, the user actuates trigger 20 or remote trigger 22 causing valve 162 to supply pressurized air to chamber 52 and chamber 130. When this occurs, chamber 132 is evacuated and the pressure in chamber 130 drives racks 140 forward causing pinions 146 to rotate to open valves 94 as depicted in FIG. 6. Valve 162 continues to supply pressurized air to chamber 52 driving piston 40 forward thus forcing materials 68 through valves 94 into mixing chamber 96. Material 68 continues to be dispensed in this manner until piston heads 48 and 50 abut valve block 90 as depicted in FIG. 7. When this occurs, valve 162 functions to supply pressurized air to reload chamber 132 causing valves 94 to close. Air pressure is then evacuated from chamber 52 allowing pressurized material 68 flows through valve 156 to reload chambers 66. This reloading and dispensing process is continued until sources 16 and 18 are exhausted. After sources 16 and 18 are exhausted, they may be refilled without removing storage tubes 62 from dispensing tool 12.

Figure 8:
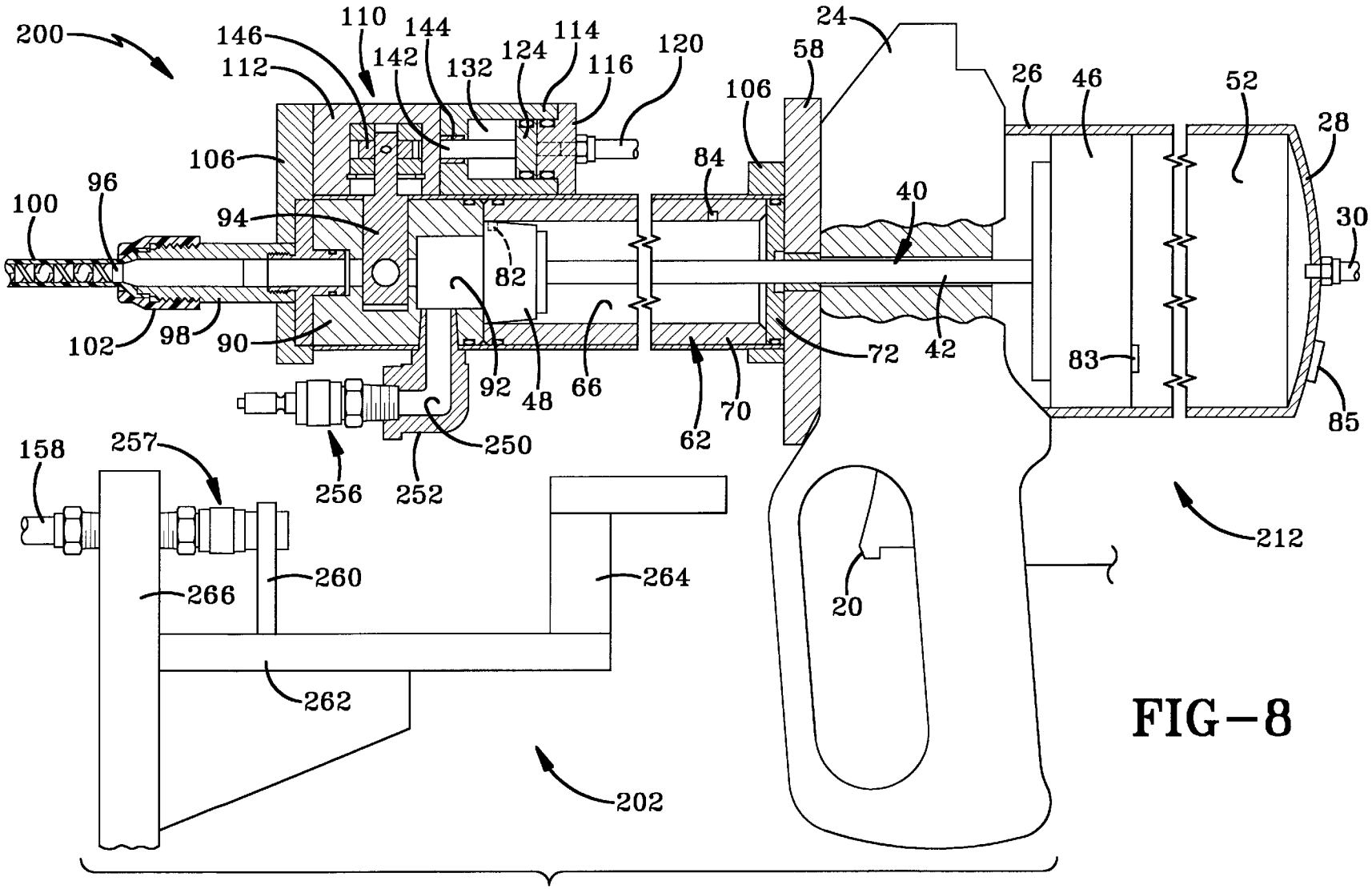
FIG. 8 is a sectional side view of a first alternative embodiment of the system of the present invention depicting a schematic holster and schematic dispensing gun with the dispensing gun unloaded and the dispensing valves closed.
Figure 9:
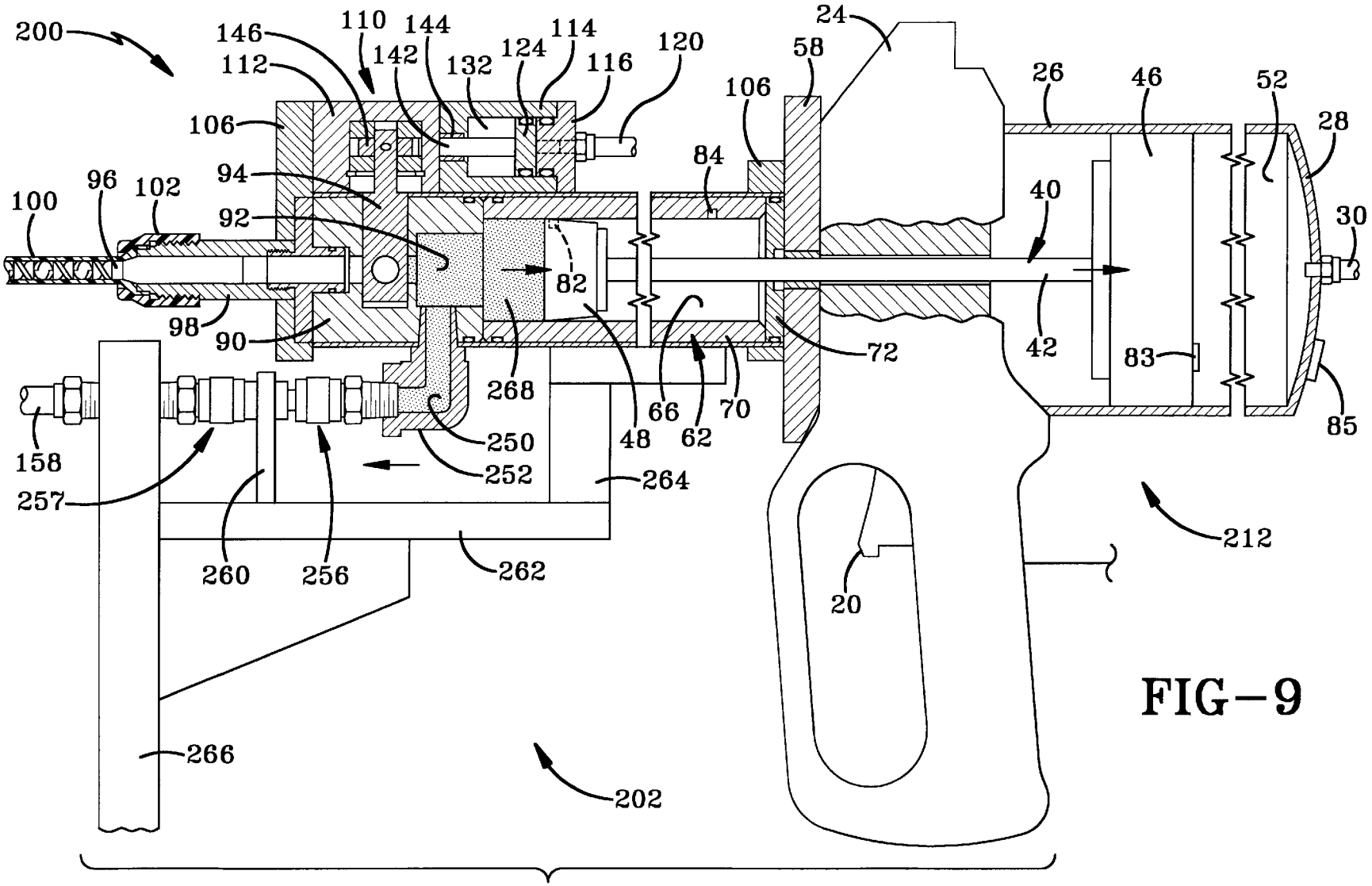
FIG. 9 is a schematic side view of the first alternative embodiment of the system of the present invention with the dispensing gun received in the reloading holster and being reloaded.

A first alternative embodiment of a system for reloading dispensing tools according to the present invention is depicted in FIGS. 8 and 9 and is indicated generally by the numeral 200. Reloading system 200 generally includes the same elements as system 10 described above in addition to a reloading holster, indicated generally by the numeral 202. Although the dispensing tool 212 is configured somewhat differently than dispensing tool 12 described above, the other elements of system 200 are substantially similar to system 10. As such, system 200 utilizes source of pressurized air 14, source 16 of first material, and source 18 of second material as above. System 200 also utilizes controllable valve 162 to control the reloading and dispensing processes.

Dispensing tool 212 includes substantially the same elements as dispensing tool 12 described above except that supply coupling 252 is arranged in a fashion such that first valve 256 automatically engages a second valve 257 carried by holster 202 when dispensing tool 212 is placed in holster 202. Such engagement causes tool 212 to be automatically reloaded in accordance with another objective of the present invention. In the embodiment of system 200 depicted in FIGS. 8 & 9, coupling 252 is turned 180° so that its opening faces forward. First valve 256 is carried by coupling 252 such that supply passageway 250 is selectively opened and closed by valve 256. Valve 256 may be any of a variety of valves known in the art but may be particularly a check valve in the embodiment of the invention depicted in FIGS. 8 and 9. Valve 256 thus permits material 268 to flow into supply passageway 250 but closes when material 68 in supply passageway 250 is pressurized to prevent material 68 from exiting tool 212 through valve 256. A spring may also be disposed in valve 256 to cause it to close when tool 212 is removed from holster 202.

Second valve 257 is similarly configured in that it may prevent material 68 from leaving reload supply line 158 unless valve 256 is coupled to second valve 257. Valve 257 thus prevents the accidental discharge of material 68 from reload supply line 158. Valves 256 and 257 are configured to cooperate such that when valve 256 is plugged into second valve 257, supply passageway 250 is in fluid communication with reload supply line 158.

Holster 202 includes a valve support 260 that maintains the position of second valve 257 for coupling with first valve 256. Holster 202 further includes a base 262 from which valve support 260 projects as well as a tool support 264. Tool support 264 is configured to support tool 212 in a position where first valve 256 may be automatically connected with valve 257. Holster 202 may be supported from a main support 266 that may be attached to a worktable, a floor, or any suitable support capable of supporting the weight of tool 212 and holster 202.

In accordance with one of the objectives of the present invention, tool 212 is operated by placing tool 212 in holster 202 and sliding it into a position where valves 256 and 257 couple to automatically reload material storage tubes 62 of tool 212. In the embodiment of the invention depicted in FIGS. 8 and 9, tool 212 is slid forward in holster 202 after tool 212 is rested on support 264. In another embodiment of the invention, tool 212 may be placed in holster 202 and then pulled back to cause valves 256 and 257 to engage.

FIG. 8 depicts tool 212 in an empty condition with valves 94 in the closed position. Tool 212 in FIG. 8 may be reloaded by placing tool 212 on holster 202 and sliding tool 212 forward such that first valve 256 engages second valve 257 to provide fluid communication between supply passageway 250 and reload supply line 158. When such fluid communication occurs, material 68 to be reloaded is under pressure in reload supply line 158 and immediately flows into supply passageway 250 and into passageway 92 and then into chamber 66. Material 68 is under sufficient pressure to push drive piston 40 back until common pneumatic drive piston head 46 engages end wall 28 and first material drive piston head 48 is disposed at the end of tube 62. When piston head 48 reaches this position, sensor elements 82 and 84 cooperate to create a signal that informs the user that tool 212 is filled with material to be dispensed. Tool 212 may then be used to dispense material 68 by opening and closing valves 94 and providing selective air pressure to chamber 52. Such dispensing occurs until drive piston 40 reaches the position depicted in FIG. 8 where tool 212 must be reloaded.

Figure 10:
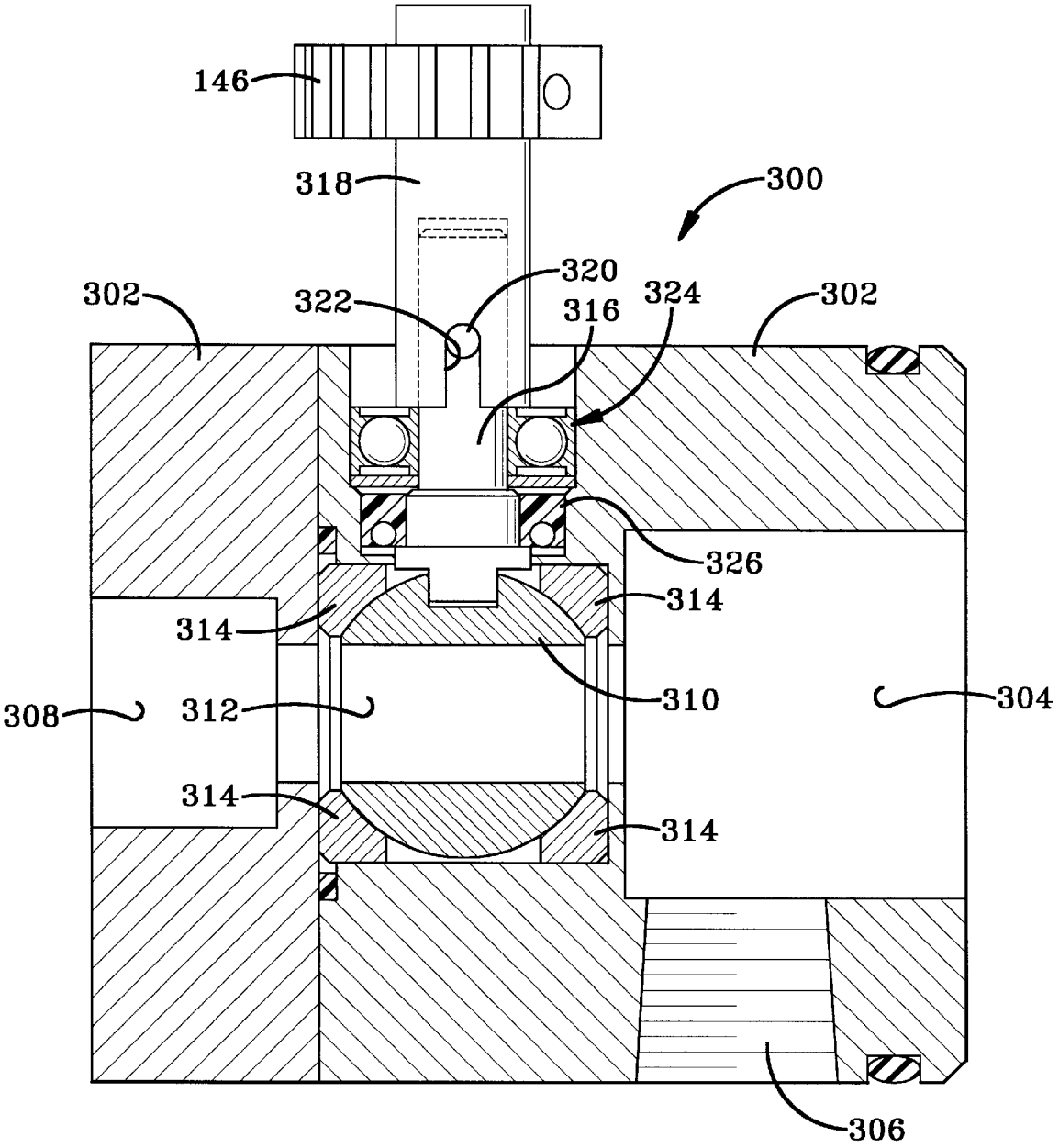
FIG. 10 is an enlarged sectional view of the front of the dispensing tool showing an alternative valve arrangement.

An alternative valve arrangement is depicted in FIG. 10 and is indicated generally by the numeral 300. Valve arrangement 300 also includes a valve block 302 that may be formed in multiple pieces for easy fabrication and assembly or may be fabricated from a single integral piece. Valve block 302 defines a passageway 304 that is positioned to be in fluid communication with the chamber of storage tube 62. Passageway 304 is in fluid communication with a supply passageway 306 that allows material to be loaded into tool 12. Valve block 302 further includes an outlet passageway 308 that is selectively connected with passageway 304 by a ball 310 having a valve passageway 312 therethrough that is selectively rotated between open and closed positions.

Ball 310 is rotatably seated in a plurality of ball valve seats 314 that allow ball 310 to smoothly rotate between the open and closed positions without binding.

Ball 310 is rotated by a first shaft 316 that engages ball 310 in an interference fit. First shaft 316 is selectively connected to a second shaft 318 so that shafts 316 and 318 rotate together. This connection is achieved by a pin 320 projecting out from first shaft 316. Pin 320 is received in a slot 322 formed in the hollow end of second shaft 318. The upper end of shaft 318 is connected to gear 146. The function and operation of gear 146 is described above.

Valve arrangement 300 further includes a ball bearing assembly 324 that allows shafts 316 and 318 to smoothly rotate with respect to valve block 302. A seal 326 is provided between valve block 302 and first shaft 316 to prevent any material from engaging ball bearing assembly 324, shafts 316 and 318, or gear 146.

It may thus be understood that valve arrangement 300 functions when gear 146 is selectively rotated as described above. Rotation of gear 146 causes shafts 316 and 318 to rotate thus rotating ball 310. The rotation of ball 310 causes valve passageway 32 to be selectively in and out of fluid communication with passageway 304 and outlet passageway 308.

Figure 11:
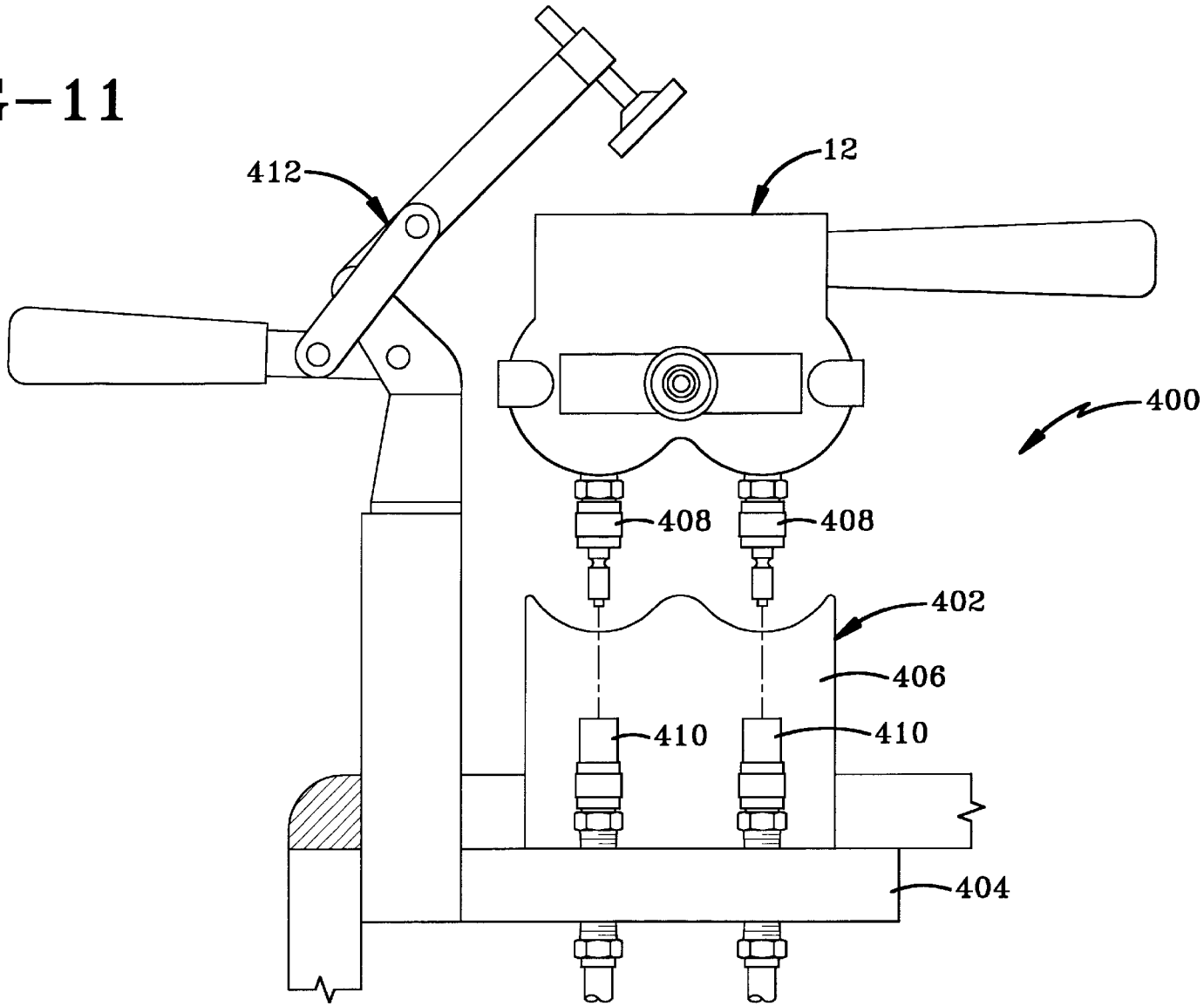
FIG. 11 is an end view of a reloading station and dispensing tool where the male and female coupling elements are vertically arranged; the coupling elements in an uncoupled position.
Figure 12:
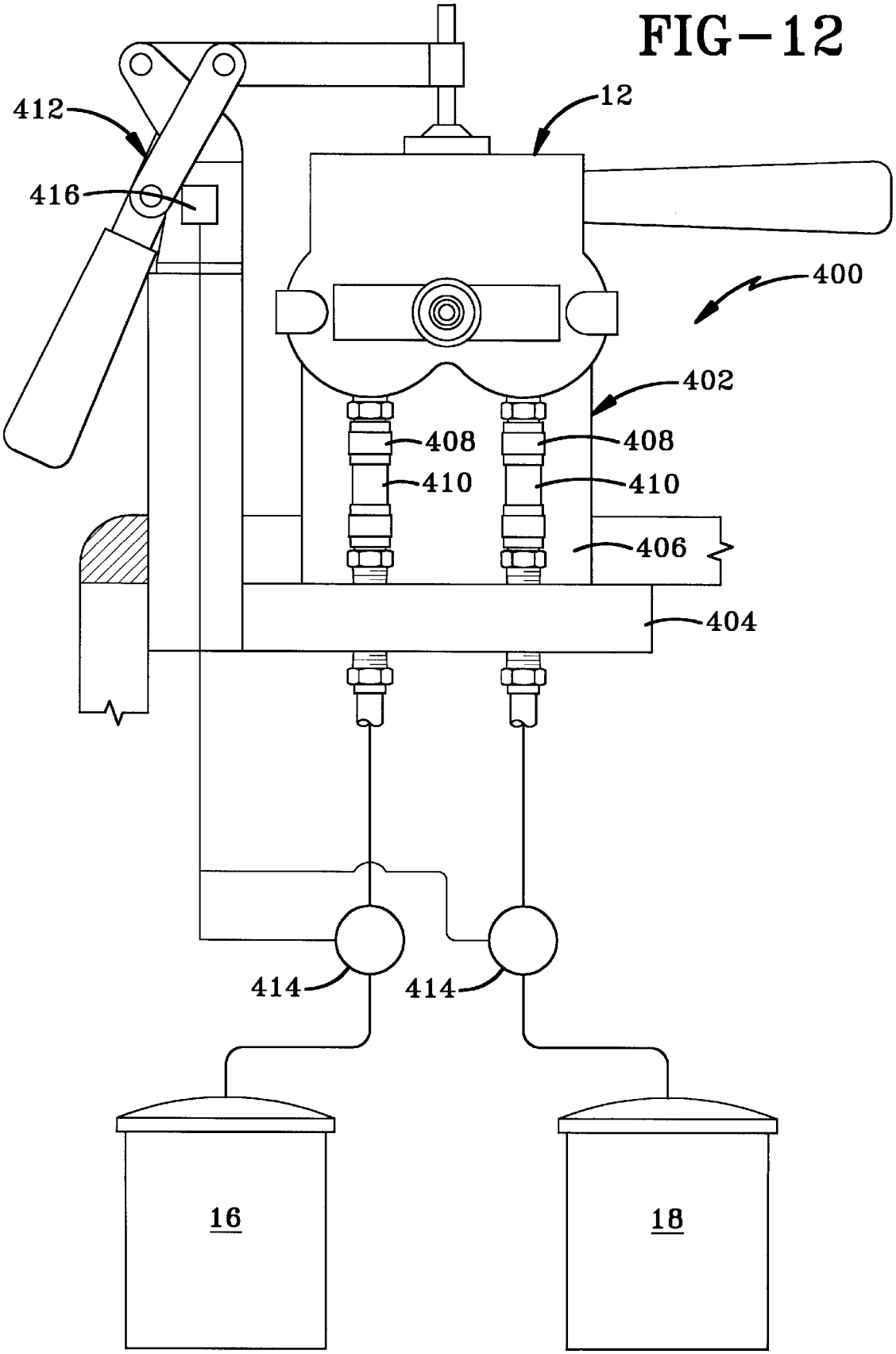
FIG. 12 is an end view similar to FIG. 11 showing the coupled position along with a schematic view of the bulk storage and pumping elements.
Figure 13:
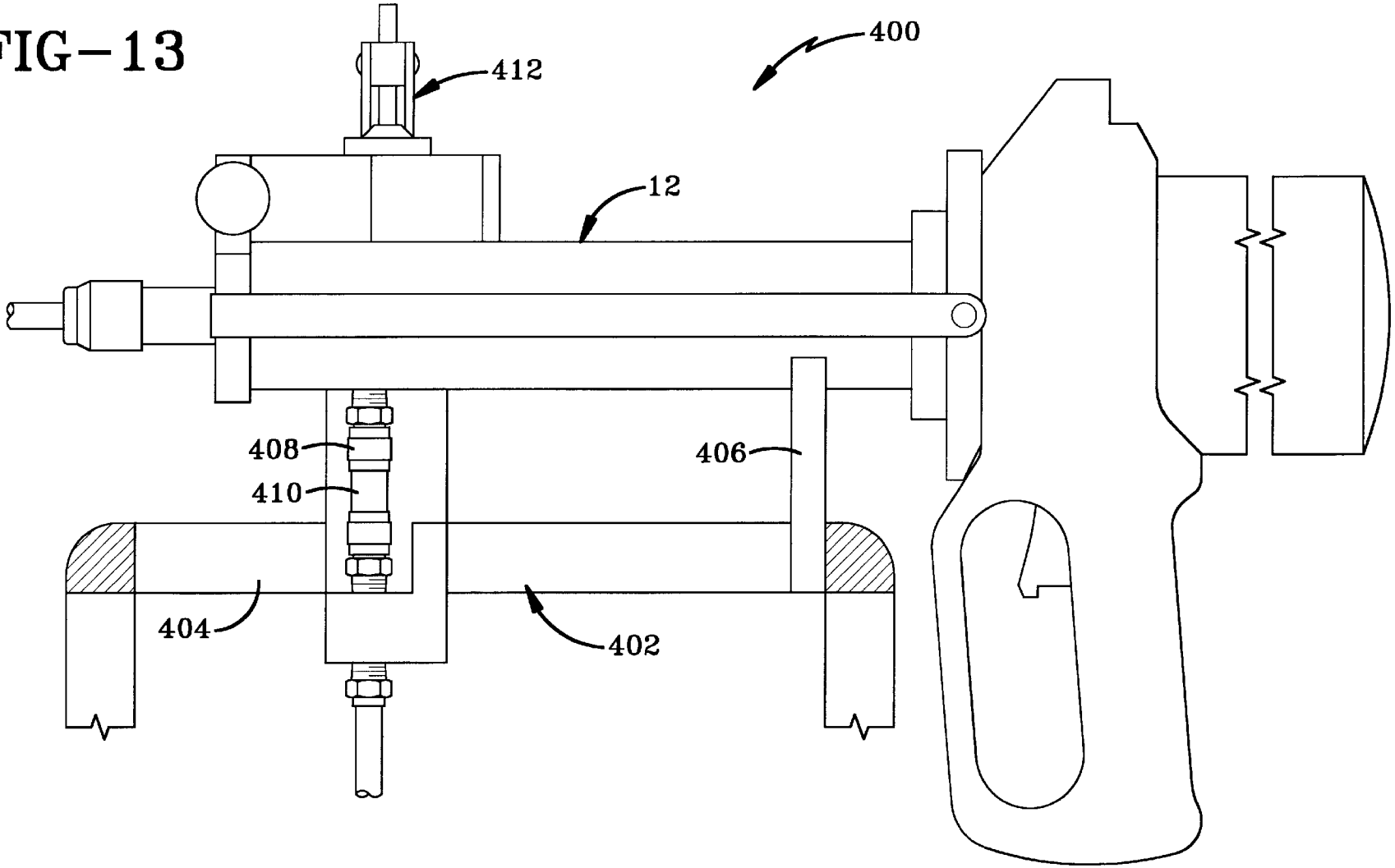
FIG. 13 is a side view of the coupled position.

Another alternative embodiment of a system for reloading dispensing tools according to the present invention is depicted in FIGS. 11–13 and is indicated generally by the numeral 400. Reloading system 400 includes a reloading holster 402 having a base 404 with at least one tool support 406. Tool support 406 is configured to receive tool 12 in a stable configuration.

Tool 12 and holster 402 are provided with elements that allow a selective connection to be provided between material storage tubes 62 and sources of bulk material 16 and 18. The selective connection is achieved by providing male and female coupling elements on tool 12 and holster 402. Although the specific arrangement of the male and female coupling elements is not important, the example of the invention depicted in the drawings discloses male coupling elements 408 carried by tool 12 with female coupling elements 410 being carried by holster 402. Coupling members 410 are positioned on holster402 such that they are automatically aligned with coupling members 408 when gun 12 is properly positioned on holster 402.

Holster 402 is further provided with a clamp 412 that is designed and configured to selectively engage tool 12 in a clamping position to force and hold coupling members and 410 together. The clamped position is depicted in FIGS. 12 and 13 with the unclamped position depicted in FIG. 11.

As described above, each source of bulk material 16 and 18 may be provided with a pump 414 that is adapted to deliver bulk material from sources 16 and 18 to tool 12. In the embodiment of the invention depicted in FIGS. 11–13, a sensor 416 is provided on clamp 412 and is communication with each pump 414. In other embodiments of the present invention, sensor 416 may be disposed on holster 402. Sensor416 is configured to create a signal indicating when clamp is in the clamped position. This signal allows pumps 414 to run only when clamp 412 is in the clamped position. When clamp 412 is in the unclamped position, sensor 416 prevents pumps 414 from operating.

Yet another reloading configuration is depicted in FIGS. 14–17 and is indicated generally by the numeral 450. System 450 also includes a holster 452 that includes a plurality of stationary blocks 454 and at least one moveable block 456. Blocks 454 are positioned and configured to hold tool 12 while it is being reloaded. At least one block 454 is configured to hold a portion of a clamp 458. Holster 452 further includes a pair of guide bars 460 on which moveable block 456 is mounted. A translation arm 462 is connected to moveable block 456 and a first end 464 of a clamp handle 466. Arm 462 is moveable by clamp 458 to translate moveable block 456 along guide bars 460.

As described above with respect to FIGS. 11–13, system 450 also includes coupling elements 468 and 470. One of coupling element 468 and 470 is a male coupling element while the other of coupling elements 468 and 470 is a female coupling element. In the embodiment of the invention depicted in FIGS. 14–17, coupling element 468 is male while coupling element 470 is female.

Figure 14:
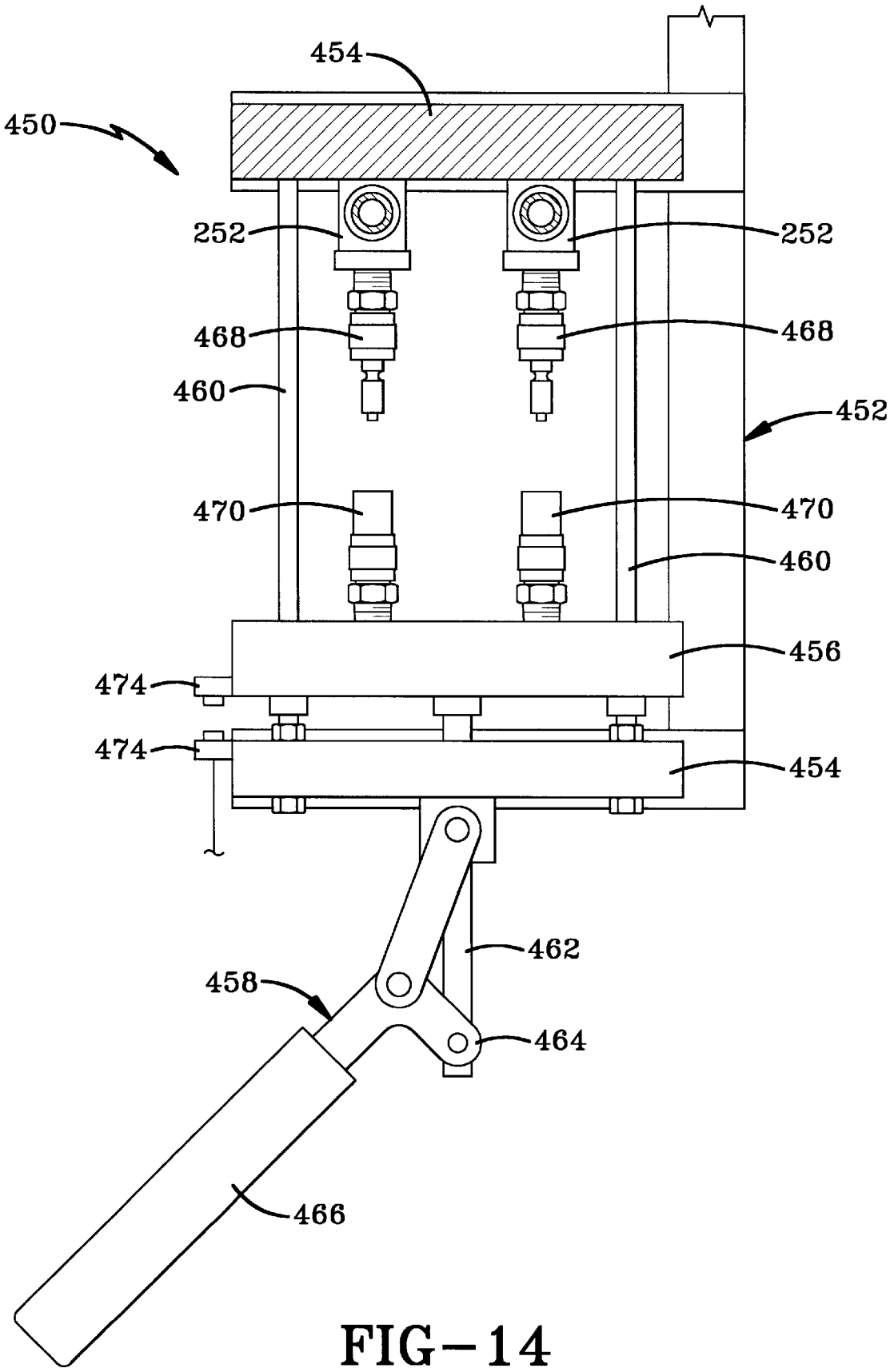
FIG. 14 is a fragmented top plan view of a second embodiment of a reloading station where the male and female coupling elements are horizontally disposed; the coupling elements in an uncoupled position.
Figure 15:
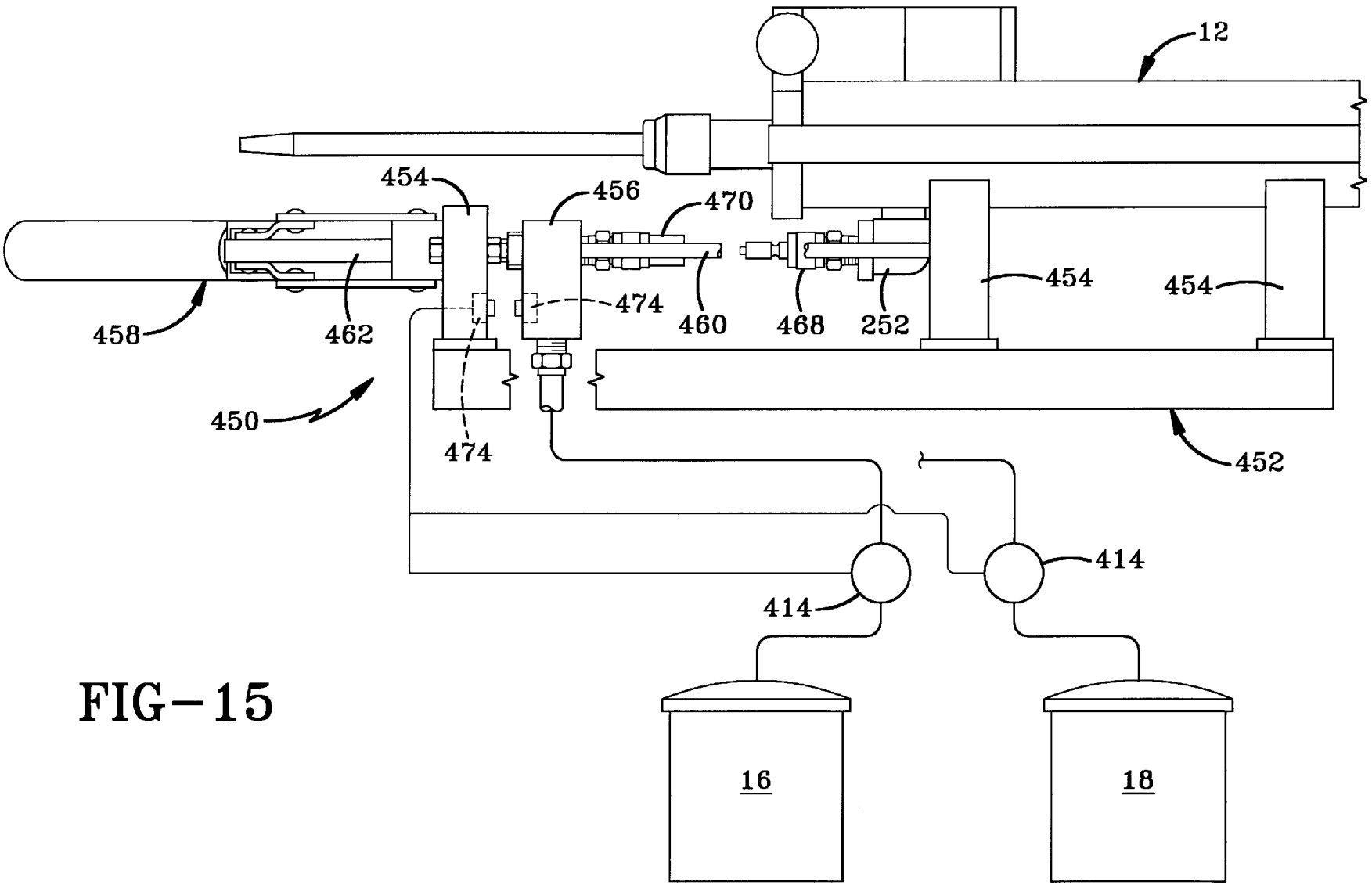
FIG. 15 is a side view of the configuration depicted in FIG. 14 with the bulk storage and pumping elements schematically depicted.
Figure 16:
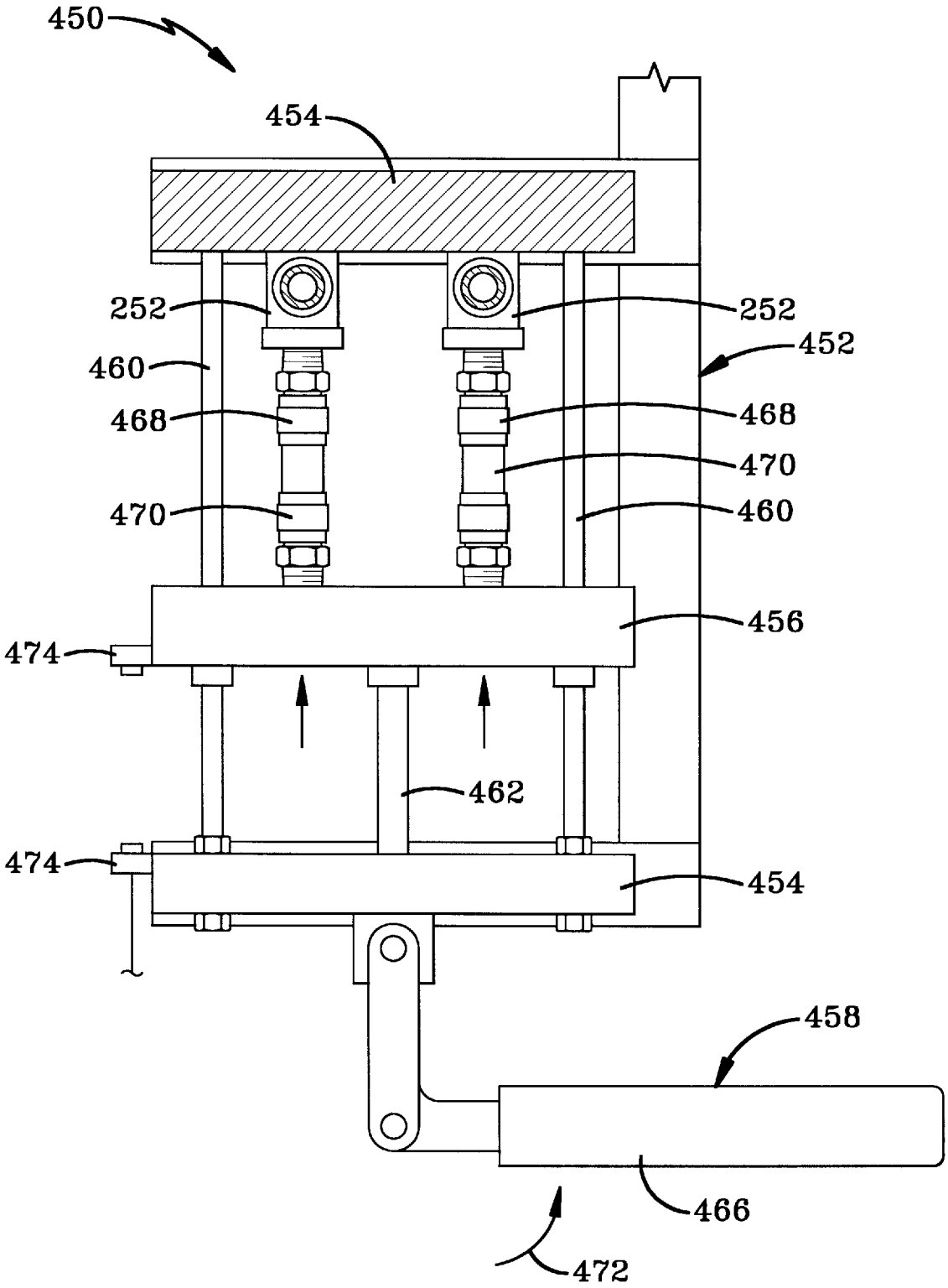
FIG. 16 is a view similar to FIG. 14 showing the coupled position.
Figure 17:
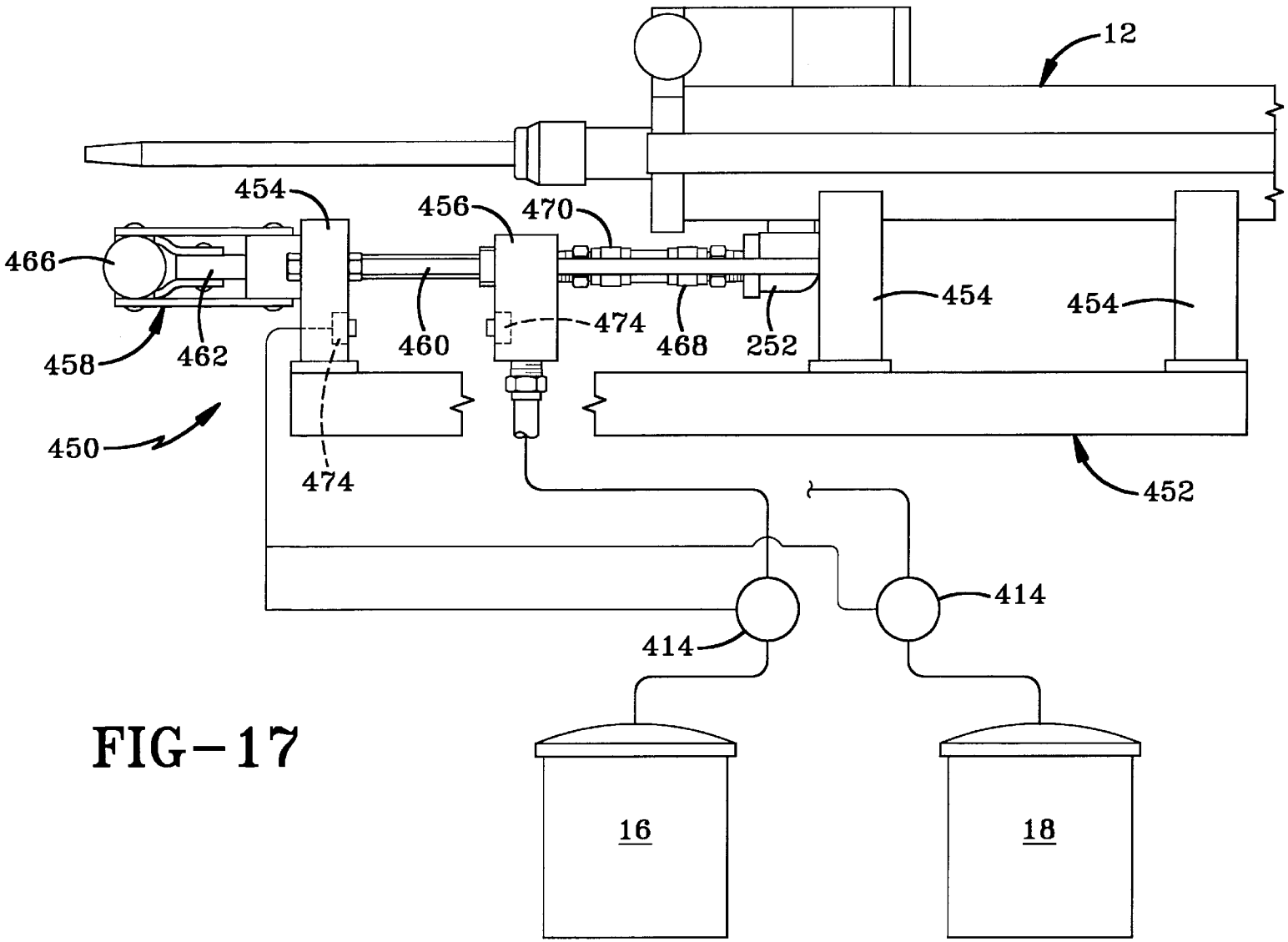
FIG. 17 is a side view of the configuration depicted in FIG. 16.

Elements 468 and 470 are depicted in the uncoupled position in FIGS. 14 and 15 while being moved to the coupled position in FIGS. 16 and 17 by clamp 458 and moveable block 456. Elements 470 are moved into the coupled position by swinging clamp arm 466 in the direction indicated by arrow 472 in FIG. 16. Tool 12 is automatically reloaded as soon as elements 468 and 470 are coupled.

As described above with respect to FIG. 12, each bulk storage source 16 and 18 is in communication with a pump 414 that allows the material from sources 16 and 18 to be delivered to tool 12. System 450 is also provided with a sensor 474 that includes a pair of sensor elements on holster 452. Sensor 474 is configured and adapted to create a signal when elements 468 and 470 are coupled and uncoupled to control pumps 414 so that pumps do not deliver material when elements 468 and 470 are uncoupled.

Figure 18:
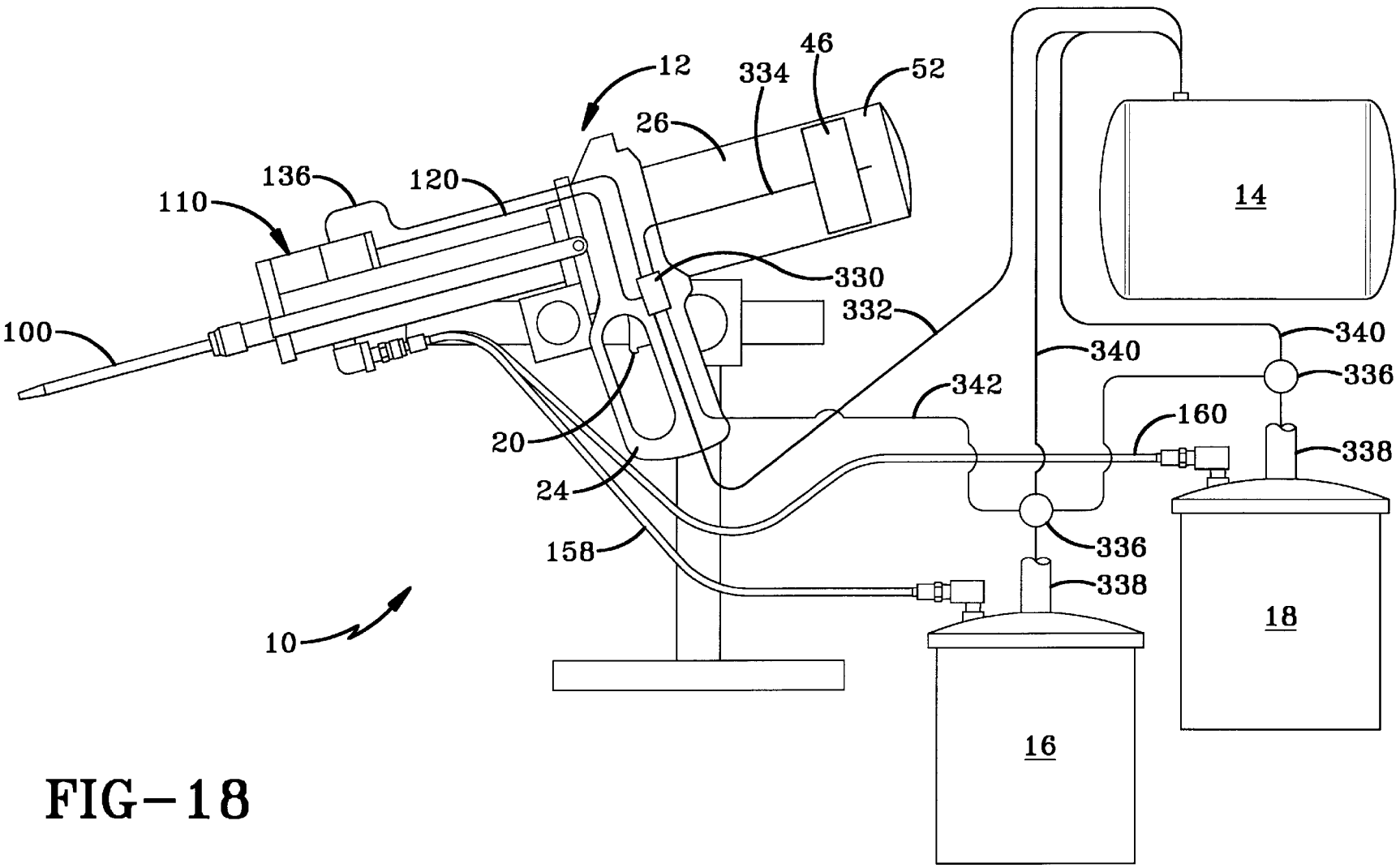
FIG. 18 is an overall schematic view of a system for reloading a dispensing gun according to an alternative embodiment of the present invention.

An alternative version of system 10 is depicted in FIG. 18 with the control system of tool 12 disposed within the handle of tool 12. In this embodiment, the control valve 330 is carried by tool 12 and is in communication with trigger 20. As shown in FIG. 18, control valve 330 is in fluid communication with compressed air supply 14 by supply line 332. Valve 330 then selectively provides fluid communication with chamber 52 by supply line 334 that passes through cylinder 26 and through drive piston head 46. This arrangement also allows air to be selectively vented from chamber 52 as required during the operation of tool 12.

As also shown on FIG. 18, control valve 330 is connected with air supply lines 120 and 136 as described above.

FIG. 18 also depicts an alternative pumping arrangement where bulk material sources 16 and 18 are connected to a pneumatic pump or drive 336 that is configured to selectively drive a piston 338 into source 16 and 18. Piston 338 forces the material in source 16 and 18 out of supply lines 158 and 160. Pump or drive 336 is thus connected to source of compressed air 14 by an air supply line 340. Each pump or drive 336 is also in communication with control valve 30 by control lines 342.

Additionally, it should be understood that the present invention may be used in both multi-part and single-part applications without departing from the spirit of the present invention.

Accordingly, the improved system for reloading dispensing tools apparatus is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the system for reloading dispensing tools is constructed and used, the characteristics of the construction, and the advantageous new and useful results obtained; the new and useful structures, devices, elements, arrangements, parts, and combinations are set forth in the appended claims.

What is claimed is:

1. A dispensing tool, comprising:

a dispensing outlet;

at least a first material storage tube having a material storage chamber and an outlet;

a drive assembly at least partially disposed within the first material storage tube;

a valve assembly selectively movable between open and closed positions; the open position providing fluid communication between the outlet of the first material storage tube and the dispensing outlet of the tool;

a source of bulk material selectively connected to the first material storage tube;

a pump in communication with the source of bulk material;

the pump being turned off when the valve assembly is in the open position.

2. The tool of claim 1, further comprising first means for actuating the valve assembly and second means for actuating the drive assembly; the means for actuating the valve assembly cooperating with the means for actuating the drive assembly to move the valve assembly to an open position when the drive assembly is actuated to allow material to be dispensed from the first material storage tube.

3. The tool of claim 2, further comprising a source of pressurized air; the first and second means being in selective fluid communication with the source of pressurized air.

4. The tool of claim 3, further comprising a control valve providing the selective fluid communication between the first and second means and the source of pressurized air.

5. The tool of claim 1, further comprising a valve disposed between the source of bulk material and the material storage tube.

6. The tool of claim 1, further comprising male and female couplers; one of the male and female couplers connected to the first material storage tube and the other of the male and female couplers connected to the source of bulk material; the male and female couplers adapted to cooperate to provide fluid communication between the source of bulk material and the first material storage tube.

7. A dispensing tool, comprising:

a dispensing outlet;

at least a first material storage tube having a material storage chamber and an outlet;

a drive assembly at least partially disposed within the first material storage tube;

a valve assembly selectively movable between open and closed positions; the open position providing fluid communication between the outlet of the first material storage tube and the dispensing outlet of the tool;

a source of bulk material selectively connected to the first material storage tube;

male and female couplers; one of the male and female couplers connected to the first material storage tube and the other of the male and female couplers connected to the source of the bulk material; the male and female couplers adapted to cooperate to provide fluid communication between the source of bulk material and the first material storage tube; and a sensor that creates a signal when the male and female couplers cooperate to provide fluid communication between the source of bulk material and the first material storage tube.

8. The tool of claim 7, further comprising a pump in communication with the source of bulk material; the pump in communication with the sensor and is adapted to turn on when the sensor creates the signal.

9. A dispensing tool, comprising:

a dispensing outlet;

at least a first material storage tube having a material storage chamber and an outlet;

a drive assembly at least partially disposed within the first material storage tube;

a valve assembly selectively movable between open and closed positions; the open position providing fluid communication between the outlet of the first material storage tube and the dispensing outlet of the tool;

a source of bulk material selectively connected to the first material storage tube;

male and female couplers; one of the male and female couplers connected to the first material storage tube and the other of the male and female couplers connected to the source of the bulk material; the male and female couplers adapted to cooperate to provide fluid communication between the source of bulk material and the first material storage tube;

a base and a clamp; the clamp movable between clamped and unclamped positions; the base adapted to receive the tool is a position where the male and female couplers are aligned.

10. The tool of claim 9, wherein the male and female couplers are engaged and cooperate to provide fluid communication when the clamp is moved to the clamped position.

11. The tool of claim 1, wherein the drive assembly includes:

a cylinder; and a piston head disposed in the cylinder to form a chamber within the cylinder.

12. A dispensing tool, comprising:

a dispensing outlet;

at least a first material storage tube having a material storage chamber and an outlet;

a drive assembly at least partially disposed within the first material storage tube; the drive assembly including a cylinder and a piston head disposed in the cylinder to form a chamber within the cylinder;

a valve assembly selectively movable between open and closed positions; the open position providing fluid communication between the outlet of the first material storage tube and the dispensing outlet of the tool; and a sensor carried on the piston head and a sensor carried on the cylinder; the sensors being aligned and adapted to create a indication signal when the sensors are adjacent each other.

13. The tool of claim 12, further comprising a piston head disposed in the first material storage tube and a shaft disposed between the piston head in the material storage tube and the piston head disposed in the cylinder.

14. The tool of claim 1, further comprising means for indicating when the material storage chamber is full.

15. A dispensing tool, comprising:

a dispensing outlet;

at least a first material storage tube having a material storage chamber and an outlet;

a drive assembly at least partially disposed within the first material storage;

a valve assembly selectively movable between open and closed positions; the open position providing fluid communication between the outlet of the first material storage tube and the dispensing outlet of the tool;

the valve assembly including a body, a valve having a passageway therethrough selectively movably carried by said body between open and closed positions; and a pinion gear connected to the valve.

16. The tool of claim 15, wherein the valve assembly further includes a rack selectively slidably carried by said body; said rack meshingly engaging said pinion gear.

17. A dispensing tool, comprising:

a dispensing outlet;

at least a first material storage tube having a material storage chamber and an outlet;

a drive assembly at least partially disposed within the first material storage;

a valve assembly selectively movable between open and closed positions; the open position providing fluid communication between the outlet of the first material storage tube and the dispensing outlet of the tool;

the valve assembly including a pneumatic actuator having a piston disposed in a cylinder; the pneumatic actuator adapted to open and closed the valve assembly.

18. The tool of claim 17, wherein the cylinder of the valve assembly has a chamber on either side of the piston; each of the chambers having an inlet.

19. The tool of claim 18, further comprising a source of compressed air selectively in fluid communication with each of the inlets to the chamber.

20. The tool of claim 19, further comprising means for corresponding the communication of the source of compressed air with the inlets to the chamber to the actuation of the drive assembly.

21. The tool of claim 15, wherein the valve includes a ball having the passageway therethrough and a shaft connected to the ball.

22. The tool of claim 21, wherein the shaft includes a first shaft; a second shaft slidably connected to the first shaft; and a pin extending from the first shaft; the pin engaging the second shaft such that the first and second shafts rotate together.

23. A dispensing tool, comprising:

a material storage unit defining a material storage chamber; the material storage unit having an outlet; the material storage chamber adapted to hold material to be dispensed through the outlet;

a drive assembly adapted to selectively dispense material out of the material storage chamber through the outlet;

a valve assembly selectively movable between open and closed positions; the open position allowing material in the material storage chamber to be dispensed from the material storage unit;

a source of bulk material selectively connected to the material storage unit;

pump means for delivering material from the source of bulk material into the material storage chamber of the material storage unit;

a second material storage unit having a material storage chamber and an outlet;

the drive assembly adapted to selectively push material out of the material storage chamber through the outlet of the second material storage unit; and the open position of the valve assembly allowing material in the second material storage chamber to be dispensed from the second material storage unit.

24. The tool of claim 23, further comprising a body having a mixing chamber; the mixing chamber in fluid communication with each of the material storage chambers when the valve assembly is in the open position.

25. The tool of claim 24, in combination with a material that is mixed by combining a volume of a first material with a volume of a second material; the volumes forming a defined ratio; the volumes of the first material storage chamber forming the same defined ratio with the volume of the second material storage chamber.

26. The tool of claim 25, wherein the first material is stored in a first bulk material storage container and the second material is stored in a second bulk material storage container; the first bulk material storage container being in selective communication with the first material storage chamber; and the second bulk material storage container being in selective communication with the second material storage chamber.

27. A method for dispensing material from and reloading material into a dispensing tool having at least a first material storage unit having a first material storage chamber with an inlet and an outlet; the method comprising the steps of:

sealing the inlet to the material storage chamber;

providing a valve at the outlet to the material storage chamber;

opening the valve;

dispensing material from the material storage chamber with a drive assembly;

closing the valve assembly; and refilling the material storage chamber by pumping material into the inlet of the material storage unit.

28. A method for dispensing material from and reloading material into a dispensing tool having at least a first material storage tube having a first material storage chamber with an inlet and an outlet; the method comprising the steps of:

sealing the inlet to the material storage chamber;

providing a valve at the outlet to the material storage chamber;

opening the valve;

dispensing material from the material storage chamber with a drive assembly;

closing the valve assembly;

delivering material into the inlet of the material storage tube to refill the material storage tube; and creating an indicating signal when the material storage chamber is full.

29. The method of claim 27, further comprising the step of linking the actuation of the valve to the actuation of the drive assembly so that the valve is open when material is being dispensed and the valve is closed when drive assembly is unactuated.

30. The method of claim 29, further comprising the steps of:

providing a valve;

providing a source of pressurized air; and manipulating a valve to deliver pressurized air to the drive assembly while simultaneously delivering pressurized air to the valve assembly.

31. The method of claim 27, further comprising the steps of:

providing a source of bulk material; and providing male and female coupling elements with one of the male and female coupling elements being connected to the first material storage tube and the other of the male and female coupling elements being connected to the source of bulk material.

32. The method of claim 31, further comprising the step of connecting the coupling elements to provide fluid communication between the source of bulk material and the material storage chamber.

33. The method of claim 32, further comprising the step of clamping the coupling elements together and delivering the bulk material to the material storage chamber while the elements are clamped together to fill the material storage chamber.

34. The method of claim 33, further comprising the step of automatically stopping the delivery step when the coupling elements are disconnected.

35. A dispensing tool, comprising:

a material storage unit defining a material storage chamber; the material storage unit having an outlet; the material storage chamber adapted to hold material to be dispensed through the outlet;

a drive assembly adapted to selectively dispense material out of the material storage chamber through the outlet;

a valve assembly selectively movable between open and closed positions; the valve assembly disposed adjacent the outlet of the material storage unit; the open position of the valve assembly allowing material in the material storage chamber to be dispensed from the material storage unit;

a source of bulk material selectively connected to the material storage unit;

pump means for delivering material from the source of bulk material into the material storage chamber of the material storage unit;

a base adapted to receive the dispensing tool;

a clamp cooperating with the base; the clamp movable between clamped and unclamped positions; and the clamp adapted to create the connection between the source of bulk material and the material storage unit.

36. The tool of claim 35, further comprising connectors disposed between the material storage chamber and the source of bulk material; the connectors being moved to a joined position when the clamp is moved to the clamped position.

37. The tool of claim 36, wherein the valve assembly is automatically maintained in the closed position when the clamp is in the clamped position.

38. A dispensing tool, comprising:

a dispensing outlet;

at least a first material storage unit having a material storage chamber and an outlet;

a drive assembly adapted to selectively dispense material from the material storage unit;

a valve assembly disposed adjacent the outlet of the material storage chamber;

the valve assembly selectively movable between open and closed positions;

the open position providing fluid communication between the outlet of the first material storage tube and the dispensing outlet of the tool; and an actuator associated with the valve assembly; the actuator adapted to selectively open and closed the valve assembly.

39. The tool of claim 38, wherein the actuator is pneumatically operated.

* * * * *